US010195539B2

(12) United States Patent
Vaillancourt et al.

(10) Patent No.: US 10,195,539 B2
(45) **Date of Patent: *Feb. 5, 2019**

(54) TOY CONSTRUCTION ELEMENT WITH MOVING MEMBER

(71) Applicant: MEGA Brands Inc., Montreal (CA)

(72) Inventors: Charles Vaillancourt, Blainville (CA); Louis-Philippe Mayer, Montreal (CA); Pierre Dion, Montreal (CA)

(73) Assignee: MEGA Brands Inc., Montreal, Quebec (CA)

( * ) Notice: Subject to any disclaimer, the term of this patent is extended or adjusted under 35 U.S.C. 154(b) by 0 days.

This patent is subject to a terminal disclaimer.

(21) Appl. No.: 15/729,876

(22) Filed: Oct. 11, 2017

(65) Prior Publication Data

US 2018/0043275 A1 Feb. 15, 2018

Related U.S. Application Data

(63) Continuation of application No. 15/215,736, filed on Jul. 21, 2016, now Pat. No. 9,814,997.

(60) Provisional application No. 62/195,992, filed on Jul. 23, 2015.

(51) Int. Cl.
*A63H 33/08* (2006.01)
*A63H 33/04* (2006.01)

(52) U.S. Cl.
CPC ..... *A63H 33/042* (2013.01); *A63H 33/08* (2013.01); *A63H 33/086* (2013.01); *A63H 33/088* (2013.01)

(58) Field of Classification Search
CPC .... A63H 33/062; A63H 33/08; A63H 33/086; A63H 33/088
See application file for complete search history.

(56) References Cited

U.S. PATENT DOCUMENTS

| | | | |
|---|---|---|---|
| 454,603 | A | 6/1891 | Phillips |
| 1,308,201 | A | 7/1919 | Smith |
| 2,837,862 | A | 6/1958 | Cleveland |
| 3,035,564 | A | 5/1962 | Hellman |
| 3,233,358 | A | 2/1966 | Dehm |

(Continued)

FOREIGN PATENT DOCUMENTS

| | | |
|---|---|---|
| FR | 325559 | 5/1903 |
| GB | 1452806 | 10/1976 |
| WO | 2014140102 A1 | 9/2014 |

*Primary Examiner* — John Ricci

(74) *Attorney, Agent, or Firm* — Plumsea Law Group, LLC

(57) ABSTRACT

Embodiments provide a toy construction element having an outer shell and moving members that can extend from and retract into openings in a face of the outer shell. The toy construction element may have a plurality of pegs for attaching to other engagement elements (e.g., blocks or figurines) and the openings may each be centered with respect to a 2×2 arrangement of pegs on the face. The moving members may be in contact with an actuating member, e.g., opposing arms of a rocking member. As one moving member is pushed down the rocking member may lift the other moving member. Upon attaching an engagement element to the toy construction element, one moving member can be pushed down to force up the other moving member so that the engagement element is released. Other actuating members may be used, such as push-rods or camshafts.

20 Claims, 27 Drawing Sheets

(56) References Cited

U.S. PATENT DOCUMENTS

| | | | | |
|---|---|---|---|---|
| 3,457,668 | A | 7/1969 | Genin | |
| 3,724,855 | A | 4/1973 | Chu | |
| 3,788,643 | A | 1/1974 | Morrison et al. | |
| 4,279,100 | A | 7/1981 | Rivette et al. | |
| 4,313,041 | A | 1/1982 | Ohashi | |
| 4,488,373 | A | 12/1984 | Glickson et al. | |
| 4,823,532 | A | 4/1989 | Westerburgen | |
| 4,979,926 | A | 12/1990 | Bisceglia | |
| 5,253,873 | A | 10/1993 | Grattan | |
| 5,411,428 | A | 5/1995 | Orii et al. | |
| 5,697,613 | A | 12/1997 | Merino et al. | |
| 5,711,522 | A | 1/1998 | Wiggs et al. | |
| 5,779,515 | A | 7/1998 | Chung | |
| 5,788,555 | A | 8/1998 | Glynn | |
| 5,827,106 | A | 10/1998 | Crepeau et al. | |
| 6,095,351 | A | 8/2000 | Rossler | |
| 6,682,071 | B1 | 1/2004 | Carsten | |
| 6,736,691 | B1 | 5/2004 | Bach | |
| 7,666,054 | B2 | 2/2010 | Glickman et al. | |
| 7,708,615 | B2 | 5/2010 | Munch | |
| 7,979,251 | B2 | 7/2011 | Jakobsen et al. | |
| 8,376,806 | B2 | 2/2013 | Sun et al. | |
| 8,893,699 | B2 | 11/2014 | Bird et al. | |
| 8,920,207 | B2 | 12/2014 | Hageman et al. | |
| 9,168,451 | B2 | 10/2015 | Horikawa | |
| 9,814,997 | B1 * | 11/2017 | Vaillancourt ..... | A63H 33/042 |
| 2007/0119440 | A1 | 5/2007 | Andersen | |
| 2011/0263177 | A1 | 10/2011 | Lemchen | |
| 2013/0012099 | A1 | 1/2013 | Nielson | |
| 2013/0225038 | A1 | 8/2013 | Li et al. | |
| 2015/0226514 | A1 | 8/2015 | Bird et al. | |

* cited by examiner

TOY CONSTRUCTION ELEMENT WITH MOVING MEMBER

This application is a continuation of U.S. application Ser. No. 15/215,736, filed Jul. 21, 2016, now U.S. Pat. No. 9,814,997, issued Nov. 14, 2017, which claims the benefit of U.S. Provisional Application No. 62/195,992, filed Jul. 23, 2015, both of which are herein incorporated by reference in their entirety.

BACKGROUND

Field

The present embodiments relate generally to toy construction elements, and more particularly, to a block that includes moving members for interacting with other construction elements (e.g., blocks or figurines).

Background

Interlocking stackable toy construction blocks are well known in the field of toys and games. Although blocks may come in various sizes and shapes, a typical block is rectangular in shape and has upwardly projecting pegs on its top surface arranged in a matrix, and coupling means on its bottom surface for releasably interlocking the block to the top of another similar toy construction block having upwardly projecting pegs. Multiple blocks of varying shapes and sizes may be assembled into various toy constructions, such as houses, cars, airplanes, spaceships, and animals.

SUMMARY

Embodiments provide a toy construction block, which may include an outer shell having a face. A plurality of pegs may project from the face and may be arranged in a matrix and a moving member may be positioned at a location between the pegs of the matrix. The moving member may be configured to move along a translation axis that is substantially perpendicular to the face of the outer shell, between a retracted position and an extended position.

In another aspect, embodiments may provide a toy construction system including an actuating block and an engagement element. The actuating block may have an outer shell including a face. A plurality of pegs may project from the face and may be arranged in a matrix. A moving member may be positioned at a location between pegs of the matrix. The moving member may be configured to move along a translation axis that is substantially perpendicular to the face of the outer shell, between a retracted position and an extended position. The engagement element may define at least one opening for receiving a peg of the matrix of pegs. The engagement element may be configured to be attached to the actuating block by receiving in each opening of the at least one opening of the engagement element a respective peg of the matrix of pegs. The moving member may be aligned with an end portion of the engagement element when the engagement element is attached to the actuating block. The engagement element may detach from the actuating block when the moving member moves along the translation axis from the retracted position to the extended position.

In another aspect, embodiments may provide a toy construction system including an actuating construction element and an engagement construction element. The actuating construction element may have an outer shell including a face and a plurality of pegs, each peg projecting substantially perpendicularly from the face of the outer shell to an upper surface of the each peg. The face of the outer shell and the upper surfaces of the plurality of pegs may define parallel outer surfaces of the outer shell. The actuating construction element may further include a moving member configured to move along a translation axis that is substantially perpendicular to the face of the outer shell, between a retracted position and an extended position with respect to an outer surface of the parallel outer surfaces. The engagement construction element may define at least one opening for receiving a peg of the plurality of pegs. The engagement construction element may be configured to be attached to the actuating construction element by receiving in each opening of the at least one opening of the engagement construction element a respective peg of the matrix of pegs. The moving member may be aligned with an end portion of the engagement construction element when the engagement construction element is attached to the actuating construction element. The engagement construction element may be detachable from the actuating construction element by moving the moving member along the translation axis beyond the outer surface and to the extended position.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

DETAILED DESCRIPTION

Embodiments provide a construction element, such as a construction block, that can be used to detach connected blocks by way of an actuating system including a moving member. A moving member may translate through an opening in a face of the block (e.g., a top or side surface of the block) and may push off another attached construction element (e.g., another block) as the moving member is moved beyond the face. In embodiments, at least two moving members may be provided, which are actuated by a rocking member between the moving members. These types of assemblies allow for construction elements to be quickly detached for use in various play patterns, such as launching one or more blocks from the block with a moving member or facilitating the quick "demolition" of a system of blocks.

For purposes of convenience various directional adjectives are used in describing the embodiments. For example, the description may refer to the top, bottom, and side portions or surfaces of a component. It may be appreciated that these are only intended to be relative terms and, for example, the top and bottom portions may not always be aligned with vertical up and down directions depending on the orientation of a component or toy construction.

FIGS. 1-17 illustrate an embodiment of a block for use with various toy constructions. In some cases, a block may include provisions for actuating or pushing off another attached construction element, such as another block or a figurine. Such a block may comprise multiple distinct components and may be alternatively referred to as a "block assembly," an "actuating block," or simply a "block." Although the embodiments depict blocks with parts for actuating other construction elements, it may be appreciated that other kinds of construction elements (e.g., toy construction system base plates) could also be configured with the provisions discussed herein for a block including moving members and an actuating member (e.g., a rocking member).

Figure 1:
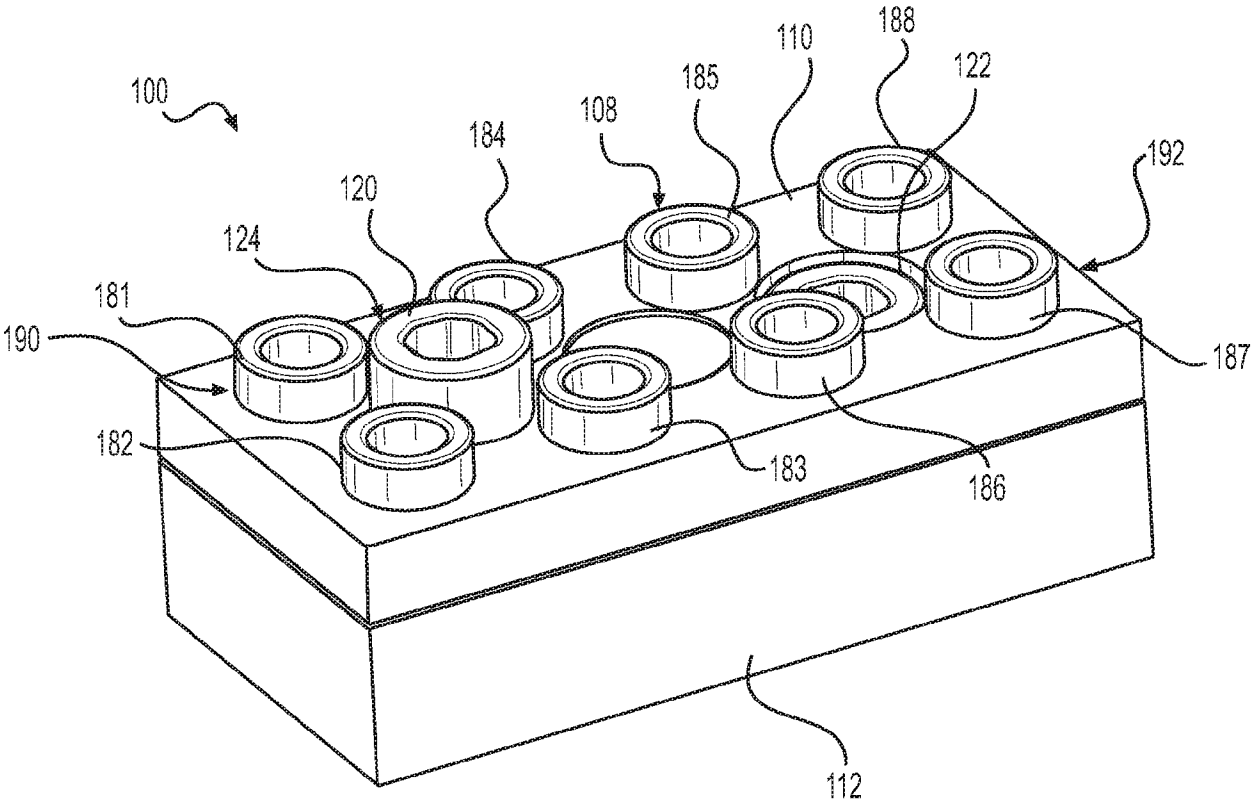
FIG. 1 is a schematic diagram that depicts an isometric perspective view of an embodiment of an actuating block for use in a toy construction.
Figure 2:
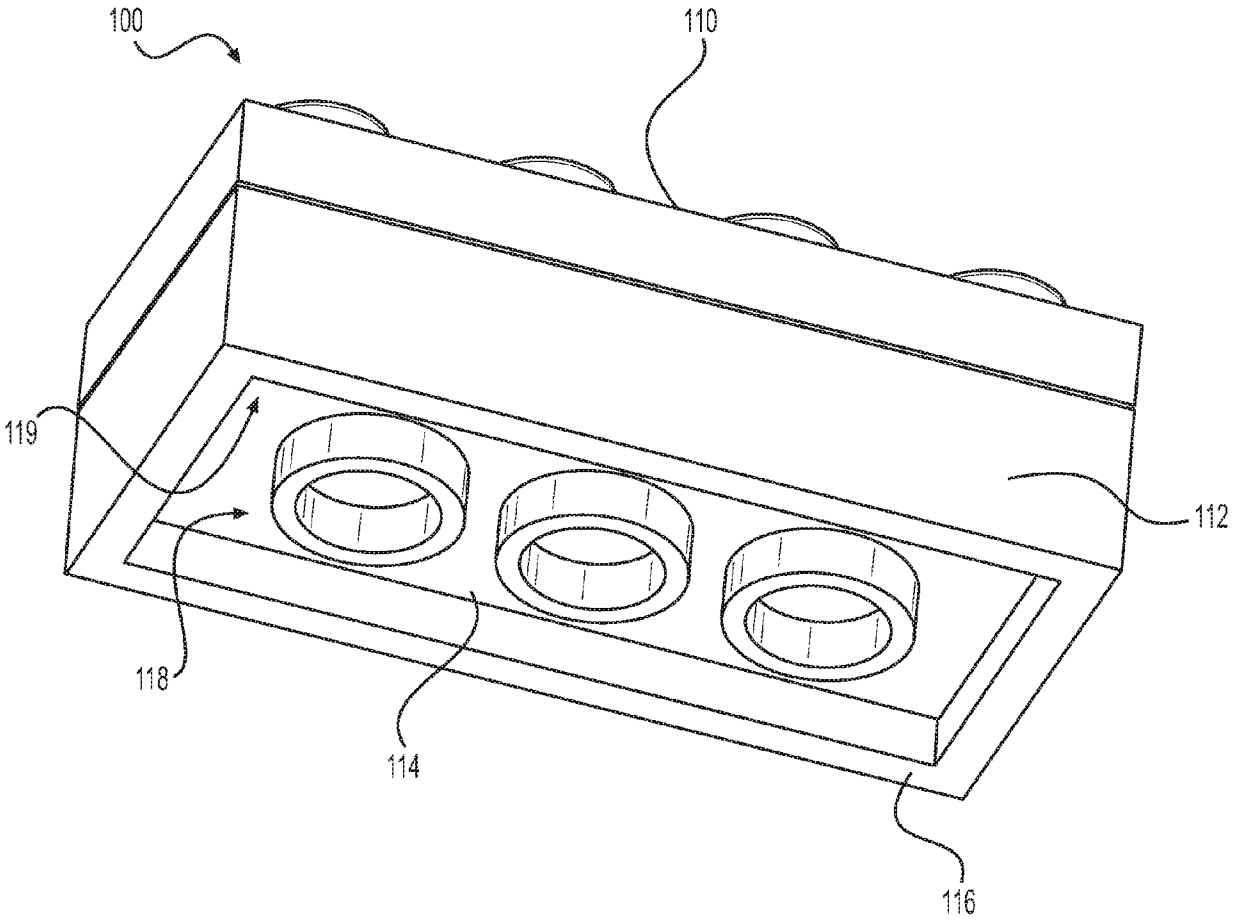
FIG. 2 is schematic diagram that depicts an isometric perspective view of a bottom side of the block of FIG. 1.

As shown in FIGS. 1-2, block 100 may comprise a block shaped assembly with various features for attaching to one or more other construction elements (e.g., blocks) or related parts, as well as for actuating or pushing off other construction elements once they have been attached. Block 100 may be comprised of a top portion 110 and a plurality of sidewall portions 112 (e.g., four sidewalls in the embodiment of FIGS. 1-17). Additionally, block 100 may include a recessed lower portion 114, which may be recessed with respect to a lower peripheral wall 116, as seen in FIG. 2. In this detailed description and in the claims, top portion 110 and sidewall portions 112 may alternatively be referred to as faces, or as sides. Each face or side may be approximately flat, apart from pegs, openings, or other structural features.

In some embodiments, block 100 may include features for interfacing with other blocks or objects. As seen in FIG. 1, block 100 may include a plurality of cylindrical pegs 108, or simply pegs 108, that protrude from top portion 110. Pegs may be alternatively referred to as studs, prongs, or cylindrical projections. Block 100 may further include one or more hollow cylindrical portions (or walls) that extend down from lower portion 114. As seen in FIG. 2, three separate hollow cylindrical portions 118 extend from lower portion 114 and may have lower surfaces that are approximately flush with the lower surface of lower peripheral wall 116.

In some embodiments, a block may also include one or more moving members or features. The term "moving member" as used throughout this detailed description and in the claims refers to any member, component, or part that can slide, move, or translate in a linear direction with respect to one or more containing members, components, or parts. As an example, a moving member could be a tappet. In the exemplary embodiments of FIGS. 1-17, each moving member may comprise an approximately cylindrical member, though in other embodiments the geometry of a moving member could vary from cylindrical and could be rectangular (in cross-section) or may have any other regular or irregular geometry. In addition, a moving member may have a hollow portion as seen in FIG. 1, or may be solid. As discussed in further detail below, in some cases, a moving member may facilitate the transfer of force between components of the block and another block or part attached to the block.

As seen in FIG. 1, block 100 may include a first moving member 120 and a second moving member 122, which may be collectively referred to as moving members 124. First moving member 120 and second moving member 122 may be configured to move through cylindrical openings in top portion 110 of block 100. As discussed in further detail below, each moving member may have a raised, or extended, position, in which the moving member may extend beyond the outer surface of top portion 110 and may also extend beyond the surface of pegs 108, and a retracted position, in which the moving member is approximately flush or recessed with respect to the outer surface of top portion 110. In this manner, a moving member may be movable with respect to an outer surface of a block. The moving members, corresponding openings, and movement of the moving members are discussed in further detail below and shown in, for example, FIGS. 18-19.

The cylindrical pegs atop block 100 and the hollow cylindrical portions disposed on a lower side of block 100 may facilitate the joining of other blocks (including other block assemblies) or various other parts with block 100. The pegs may be considered fixed with respect to the outer surface of the top portion of the block 100. The hollow cylindrical portions, or receiving couplings, of the block 100 may be considered fixed with respect to an outer surface of a bottom portion of the block 100. Exemplary construction blocks that may couple with the pegs 108 are MEGA BLOKS MICROBLOKS produced by MEGA BRANDS of Montreal, Canada. In general, toy construction blocks are well known in the art and come in various sizes and shapes. The blocks are often rectangular in shape and have upwardly projecting pegs on their top surface arranged in a matrix, and means on their bottom surface for releasably interlocking one of these blocks on top of another toy construction block. Many other shapes are possible. Using a plurality of these blocks, one may assemble various structures, such as houses, cars, and airplanes. These blocks are extremely versatile given the variety of shapes available and their easy interlocking mechanism. Examples of toy construction blocks are disclosed in U.S. Pat. No. 5,827,106, issued Oct. 27, 1998, and U.S. Pat. No. 5,779,515, issued Jul. 14, 1998, both of which are herein incorporated by reference in their entirety.

A block, or block member, may be comprised of fixed pegs that are arranged in a particular array or matrix, which may correspond to the approximate geometry of the block. Each array may be characterized by a number of rows of pegs and the number of pegs within each row (e.g., rows and columns of pegs). As an example, block 100 is configured as a 2×4 array, with pegs approximately equally spaced in 2 rows of 4 pegs each. Alternatively, a block could be configured in any other kind of array, including 1×2, 1×3, 1×4, 2×2, 2×3, 2×4, 3×3, 3×4, as well as any other arrays of pegs. Blocks with various array sizes could also be configured with different heights. As an example, blocks of various array sizes could have a ⅓ or ½ block height, where ⅓ and ½ are normalized relative to a unit block height. For example, block 100 may be configured with a standard unit block height. In still other embodiments, different portions of the same block could have different heights (e.g., a 2×4 block array could have a height of 1 standard block height in one 2×2 sub-array and a height of ⅓ in the adjacent 2×2 sub-array).

As seen in FIG. 1, block 100 includes eight total pegs, including first peg 181, second peg 182, third peg 183, and fourth peg 184, which are collectively referred to as first peg set 190, and fifth peg 185, sixth peg 186, seventh peg 187, and eighth peg 188, which are collectively referred to as second peg set 192. The pegs within first peg set 190 are arranged around an opening in top portion 110 through which first moving member 120 moves. More specifically, in some cases, first peg set 190 comprises pegs arranged in a square configuration (i.e., a 2×2 array). Similarly, the pegs within second peg set 192 are arranged around another opening in top portion 110 through which second moving member 122 moves. More specifically, in some cases, second peg set 192 comprises pegs arranged in a square configuration (i.e., a 2×2 array) that is adjacent to the square configuration of first peg set 190. Thus, embodiments may provide a block with moving members that are located approximately centrally to a square configuration of pegs. Other embodiments may position a moving member anywhere between pegs, and not necessarily centrally to four pegs.

In some embodiments, a block may be provided with a plurality of openings for receiving complementary-shaped construction toy pieces. For example, referring to FIG. 2, on lower portion 114 of block 100, hollow cylindrical portions 118 may be positioned to form distinct opening regions for receiving corresponding pegs of another block. As an example, a first opening region 119 may be associated with the adjacent sidewalls of lower peripheral wall 116 and the sidewalls of an adjacent cylindrical portion. First opening region 119 may receive a peg from another block so that an interference fit can be formed between the received peg and block 100. The configuration of block 100, with three separate hollow cylindrical portions extending from lower portion 114, provides eight distinct opening regions (which are continuous with one another), each of which may correspond with a peg on the opposing side of block 100. Thus, as with the pegs on top of block 100, the opening regions (or simply openings) on the lower side of block 100 are also configured in arrays (i.e., a 2×4 array of openings for block 100). Examples of support members and/or blocks with openings receiving construction toy pieces are disclosed in U.S. Pat. No. 7,666,054, issued Feb. 23, 2010, which is herein incorporated by reference in its entirety.

Figure 3:
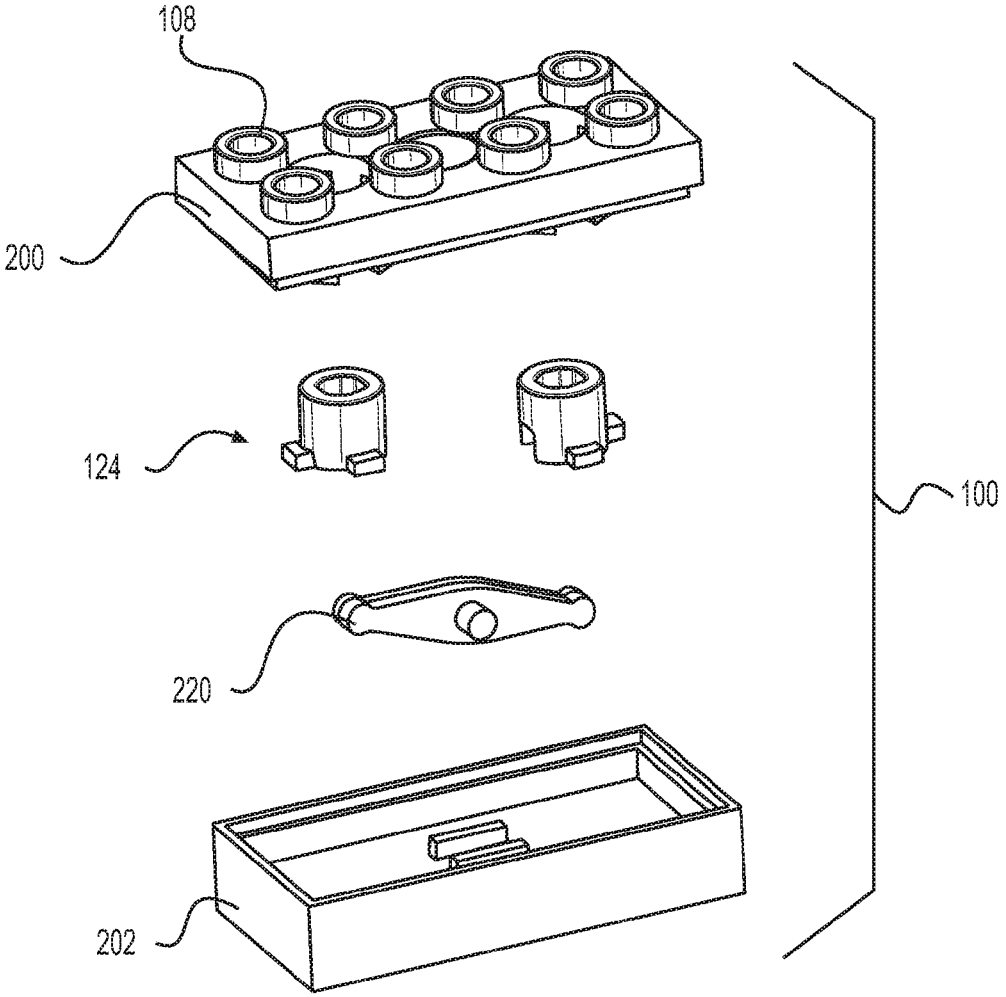
FIGS. 3-4 are schematic diagrams that depict exploded views of the block of FIG. 1.
Figure 4:
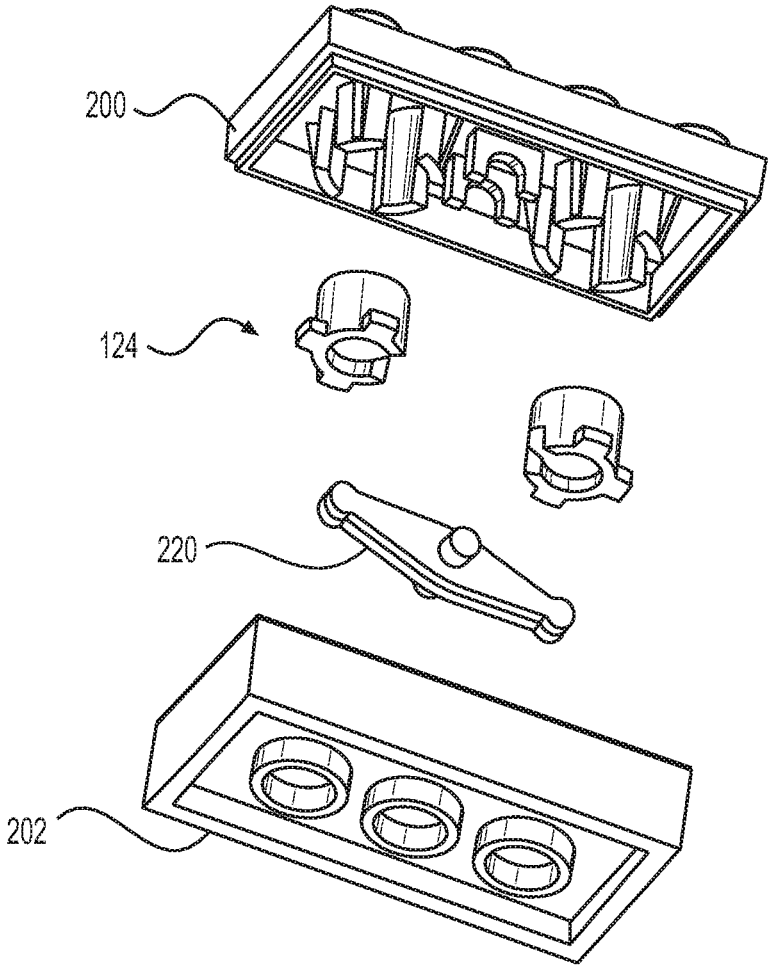

FIGS. 3-4 illustrate isometric exploded views of block 100, according to an embodiment. Referring to FIGS. 3-4, block 100 may comprise a top shell 200 and a bottom shell 202, which together comprise the outer structure (i.e., an outer shell) for block 100. In some cases, pegs 108 extend from top shell 200. Within an interior of the outer shell of block 100 formed by top shell 200 and bottom shell 202 are moving members 124 and a rocking member 220.

FIGS. 3-4 may also be seen to characterize a possible sequence of assembly of the parts, starting from the top down. Specifically, moving members 124 may be inserted into top shell 200, rocking member 220 may then be placed against top shell 200, and finally bottom shell 202 may be closed and joined to top shell 200, for example, using a welding technique.

In some embodiments the relative split or height of top shell 200 and bottom shell 202 may be determined according to the system's parts height. For example, in the embodiment of FIGS. 1-4, top shell 200 and bottom shell 202 may be $\frac{1}{3}^{rd}$ of the brick height and $\frac{2}{3}^{rd}$ of the brick height, respectively.

Embodiments of an actuating block may include provisions for retaining and guiding moving components, such as the moving members 124 and the moving rocking member 220, along with any of the other moving members or actuating members described herein. The retaining components may be provided on one or both of the top shell 200 and the bottom shell 202. For example, within the interior of the outer shell of block 100, ribs may extend from one or both of the top shell 200 and the bottom shell 202 toward an interior region of the outer shell, and may cooperate with the tabs on moving members 124 to retain, and guide the movement of, the moving members 124. In addition, supports or retaining elements may extend from one or both of the top shell 200 and the bottom shell 202 toward an interior region of the outer shell, and may cooperate with protrusions on rocking member 220 to retain, and guide the movement of, the rocking member 220.

Figure 5:
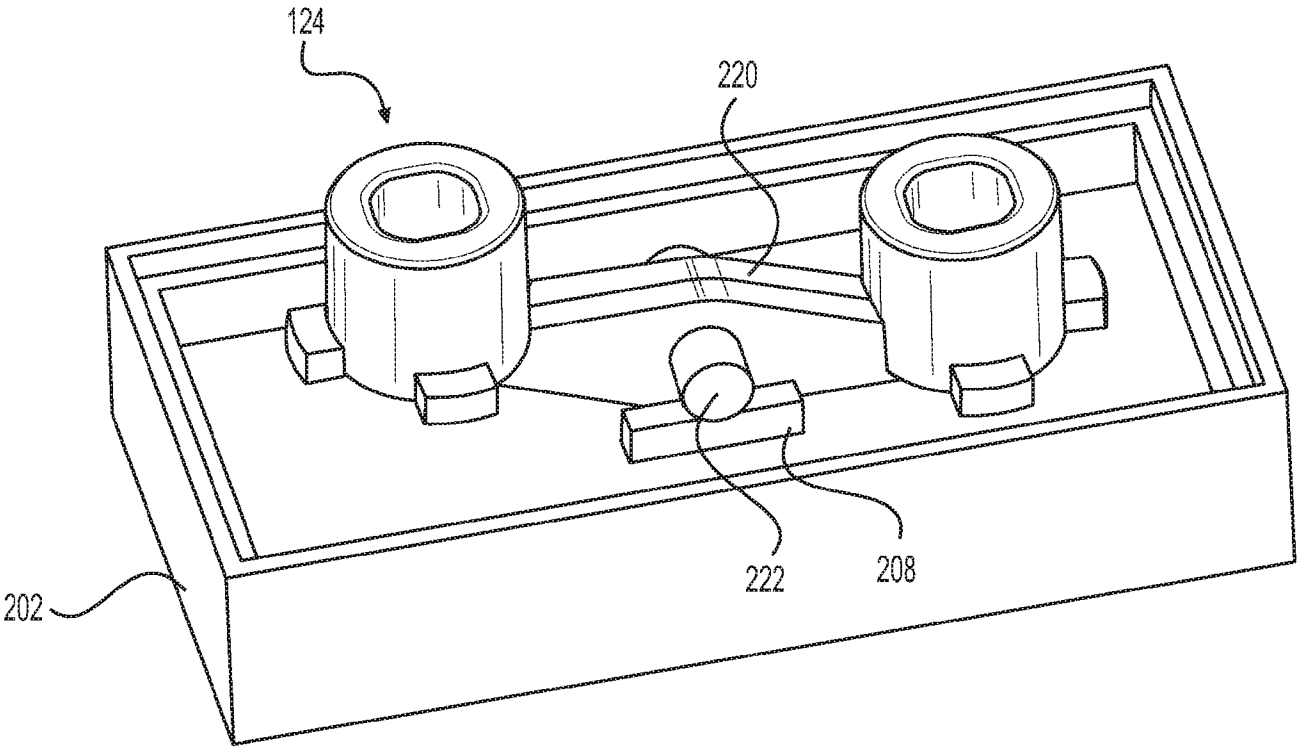
FIG. 5 is a schematic diagram that depicts an isometric perspective view of internal components and a bottom shell of the block of FIG. 1, according to an embodiment.
Figure 7:
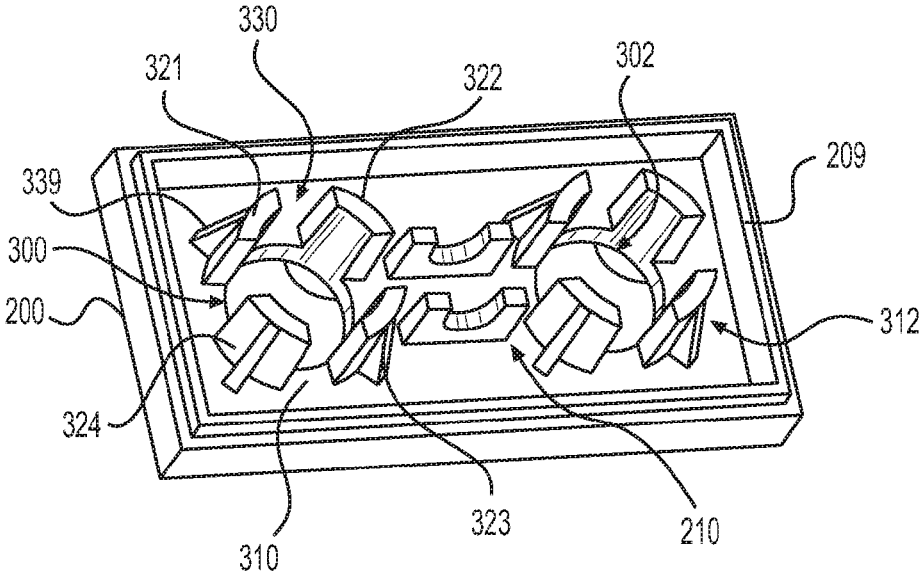
FIG. 7 is a schematic diagram that depicts an isometric perspective view of an interior side of the top shell of FIG. 6, according to an embodiment.

In one embodiment, FIG. 5 illustrates an isometric view of an embodiment of block 100 in which top shell 200 has been removed to show a view of the interior assembly. As seen in FIG. 5, rocking member 220 may include one or more pivot protrusions 222 (e.g., one on either side of rocking member 220) that rest on raised ridges 208 of bottom shell 202. As shown, raised ridge 208 may have an elongated shape with a rectangular or square lateral cross-section. Although not visible in FIG. 5, top shell 200 may include one or more retaining elements 210 (see FIG. 7) that are configured to receive protrusions 222, so that protrusions 222 are held axially in place between raised ridges 208 and retaining elements 210, yet are able to rotate. The opposing raised ridges 208 and retaining elements 210 may or may not contact each other, while holding the protrusions 220 in place. As shown in FIG. 7, retaining elements 210 may have an elongated shape with a rectangular or square cross-section, except for a round cut-out (e.g., partial circular) in which to receive a pivot protrusion 222 of a rocking member 220. Retaining elements 210 may also facilitate easy alignment of rocking member 220 within block 100 during assembly. This arrangement allows rocking member 220 to rock, teeter, or pivot about protrusions 222 to facilitate the actuation of the moving members, as discussed in further detail below. Specifically, protrusions 222 may have a cylindrical geometry and may therefore be easily rotated in the openings (e.g., circular or circular segment openings) formed between raised ridges 208 and retaining elements 210.

Figure 6:
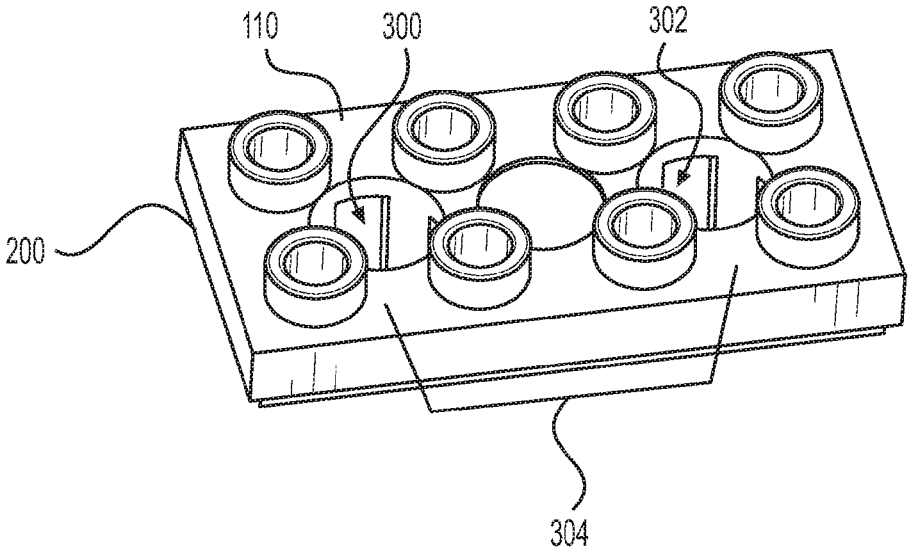
FIG. 6 is a schematic diagram that depicts an isometric perspective view of a top shell of the block of FIG. 1, according to an embodiment.
Figure 8:
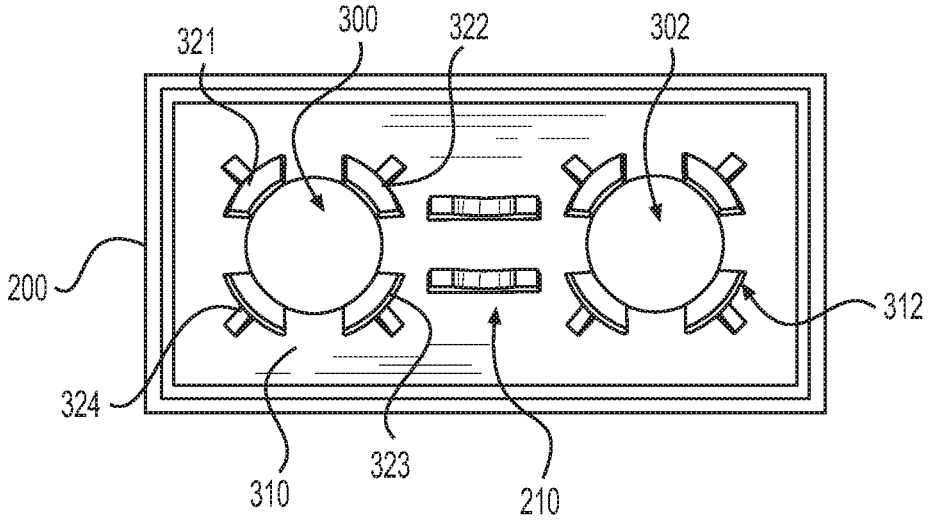
FIG. 8 is a schematic diagram that depicts a plan view of the interior side of the top shell of FIG. 6, according to an embodiment.

FIGS. 6-8 illustrate views of an embodiment of top shell 200, which for clarity is shown in isolation from the remaining parts of block 100. In some embodiments, top shell 200 may include one or more openings that extend through top portion 110. As seen in FIGS. 6-8, top shell 200 may include a first opening 300 and a second opening 302, which are referred to collectively as openings 304. Openings 304 may extend through the thickness of top portion 110 and may be aligned with a plurality of ribs 312, or segmented walls, that project out from an inner surface 310 of top portion 110. In the embodiment of FIGS. 6-8, each of the openings 304 may be associated with four separate ribs that are arranged around the perimeter of the opening and form a cylindrical opening or region in which moving members may be placed. As an example, first opening 300 may be associated with a first rib 321, a second rib 322, a third rib 323, and a fourth rib 324, which may be configured with curved inner walls and may form a cylindrical space that extends from first opening 300. Moreover, each rib may be spaced apart from adjacent ribs so as to form a slot between adjacent ribs. For example, first rib 321 and second rib 322 may be spaced apart (along the circumference of first opening 300) to form a first slot 330. In embodiments, a plurality of ribs may be spaced apart substantially equal distances from each other to form slots of substantially equal size. As seen in FIGS. 7-8, four ribs of plurality of ribs 312 are likewise arranged around the perimeter of second opening 302 to form a similar cylindrical configuration. In some embodiments, each of plurality of ribs 312 may be reinforced by a secondary rib (or stud or bracket) extending in a substantially perpendicular direction to the side surface of the rib. For example, FIG. 7 illustrates a secondary rib 339 that has a fin-like or triangular shape and extends from the inner surface 310 to a distal end of first rib 321.

Figure 9:
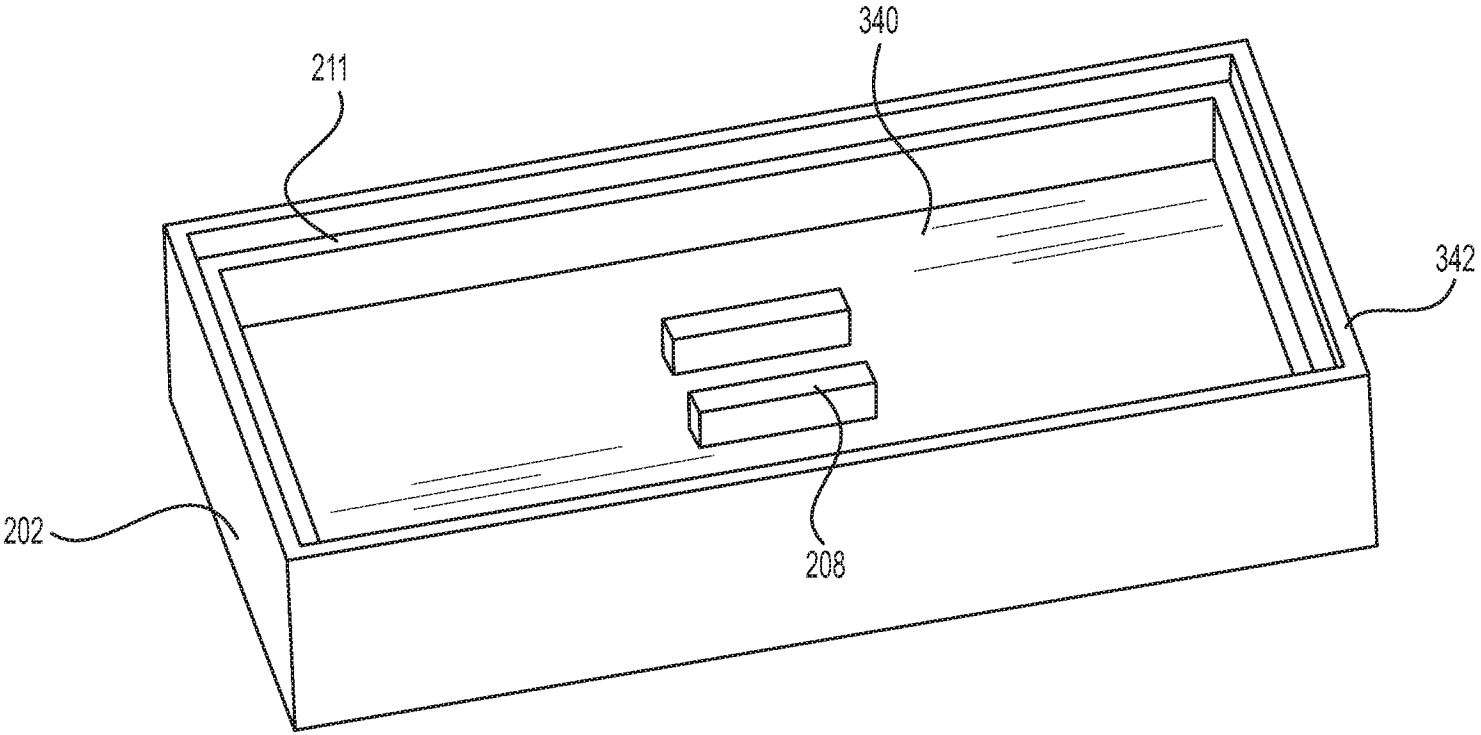
FIGS. 9-10 are schematic diagrams that depict isometric perspective views of a bottom shell of the block of FIG. 1, according to an embodiment.
Figure 10:
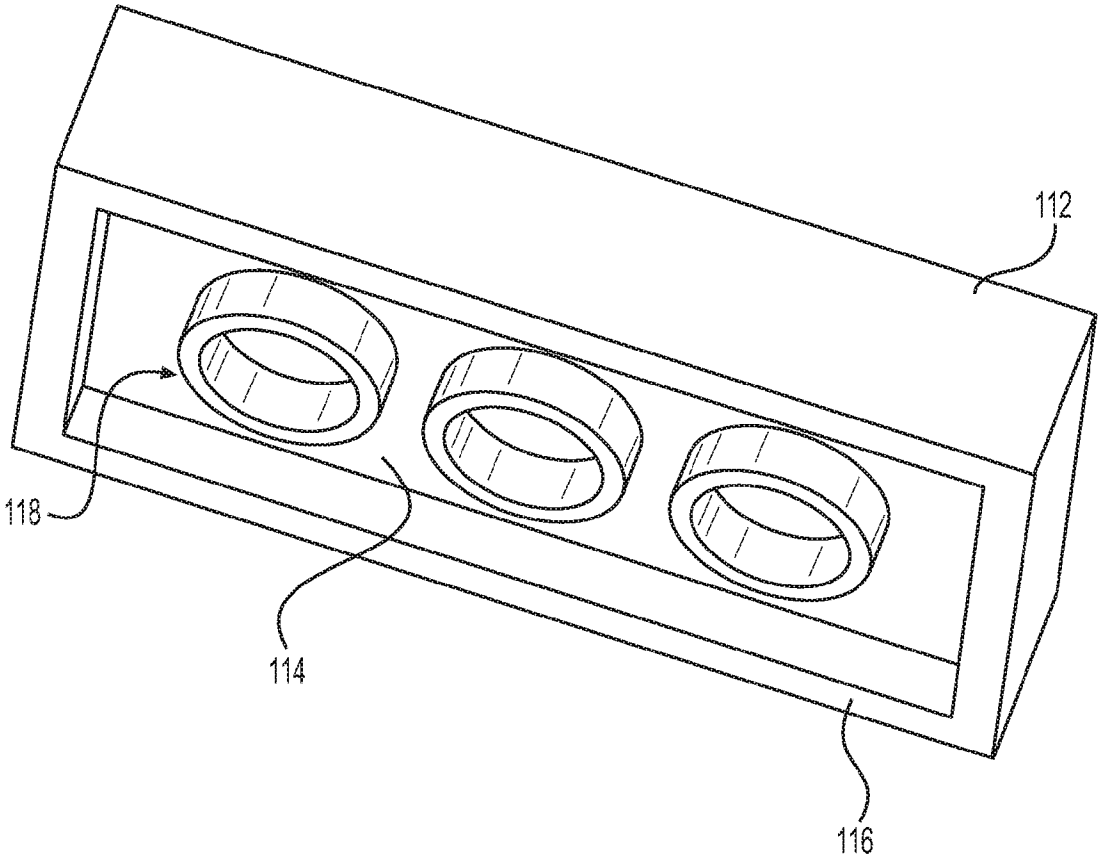
Figure 11:
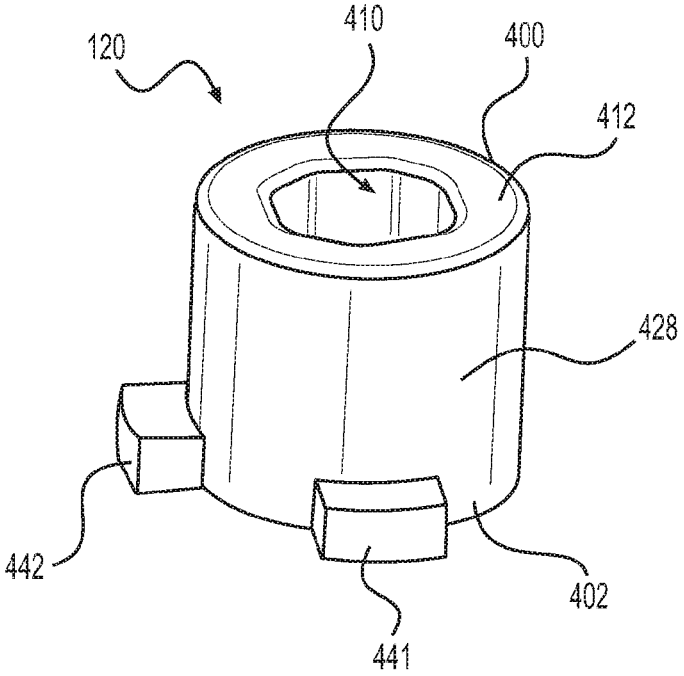
FIGS. 11-13 are schematic diagrams that depict an embodiment of a moving member.
Figure 12:
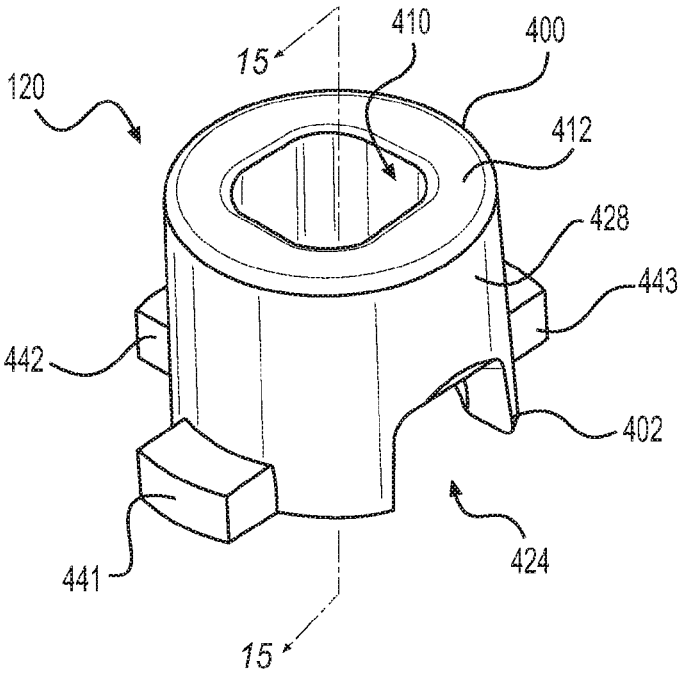
Figure 13:
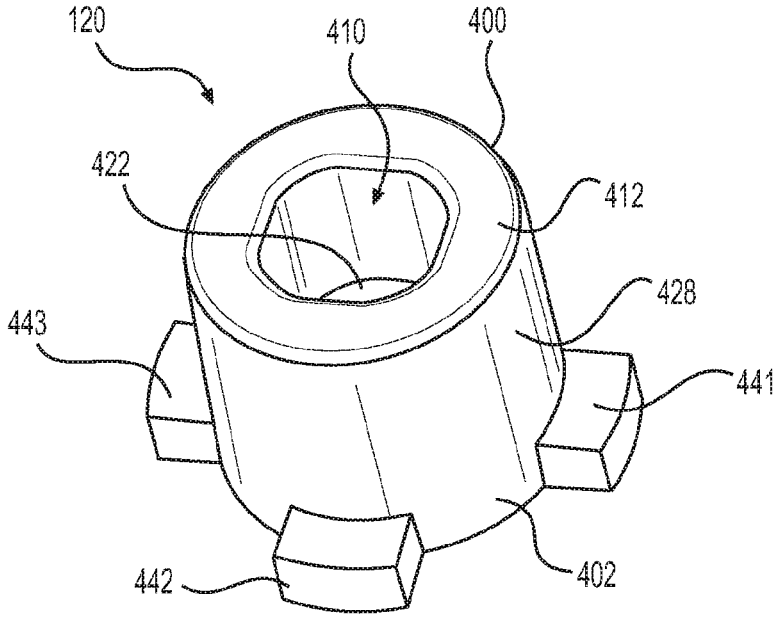

FIGS. 9-10 illustrate isometric views of bottom shell 202, according to an embodiment. As seen in FIGS. 9-10, bottom shell 202 may include an inner recessed portion 340 that is recessed from upper peripheral wall 342. Raised ridges 208 may extend up from recessed portion 340 in order to provide support for protrusions 222 of rocking member 220.

In some embodiments, a top shell and a bottom shell may include provisions for interfacing with one another. As seen in FIGS. 7 and 9, top shell 200 may include an inset wall 209 that may fit into a recessed ledge 211 of bottom shell 202. In some cases, the fit between top shell 200 and bottom shell 202 could be a frictional fit, an interference fit, or a snap fit. Such attachment means could improve ease of assembly and reduce manufacturing costs. In other cases, however, top shell 200 and bottom shell 202 could be attached using any other bonding methods known for permanently attaching materials used in the construction of blocks (e.g., plastic materials). For example, in one embodiment, top shell 200 could be glued to bottom shell 202 along their respective perimeters. In other embodiments, top shell 200 and bottom shell 202 may comprise materials that can be directly bonded using heat and/or pressure. In some embodiments, top shell 200 may be welded to bottom shell 202. In some embodiments, a sonic welding technique could be used to bond top shell 200 and bottom shell 202. Alternatively, in some embodiments, inset wall 209 and recessed ledge 211 may accommodate production variation of the top and bottom shells. In still other embodiments, a top shell could be attached to a bottom shell using a mechanical hook or similar mechanical fastener.

Figure 28:
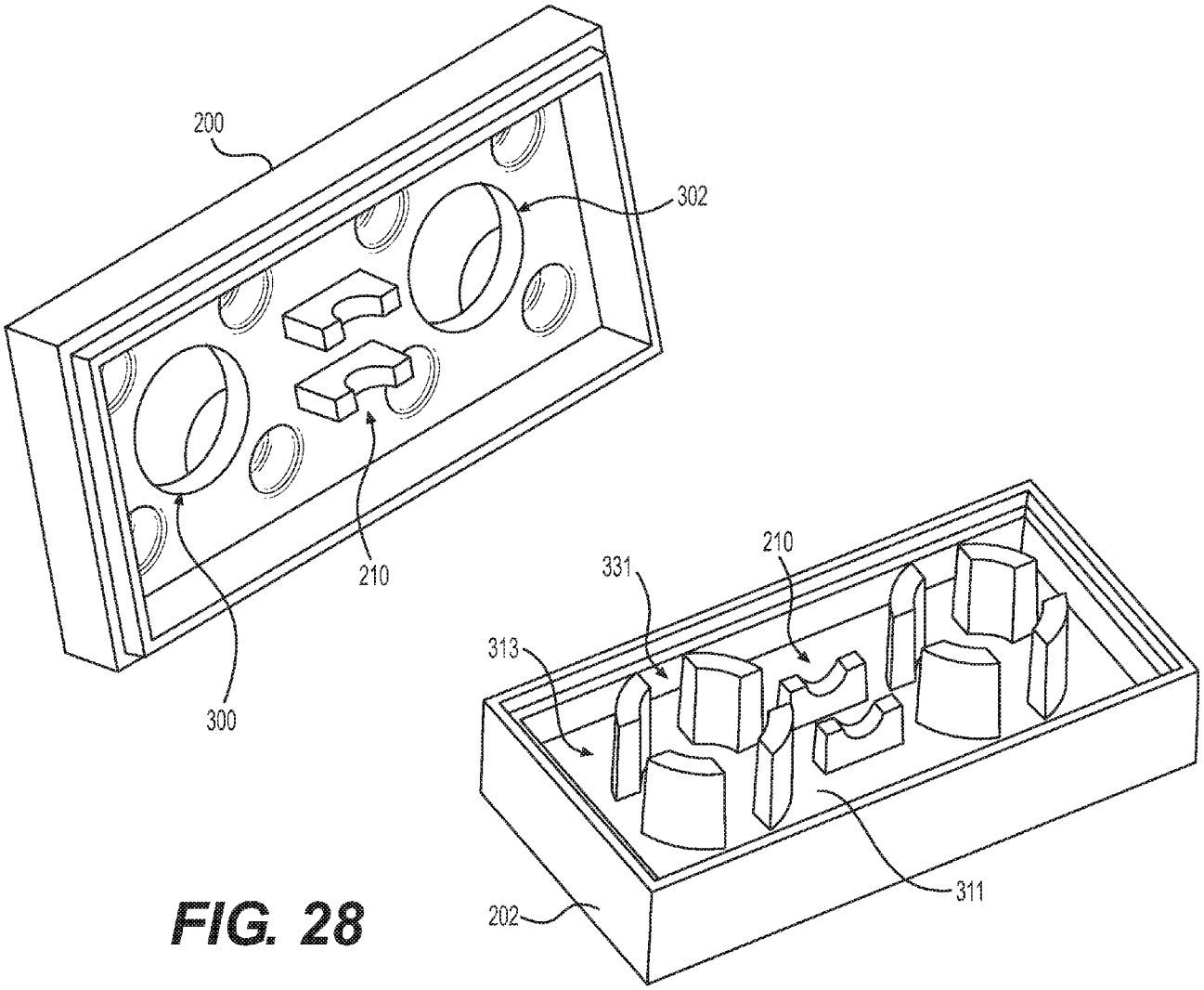
FIG. 28 is a schematic diagram depicting a top shell and a bottom shell of an actuating block for use in toy construction, according to an alternative embodiment.

In another embodiment, FIG. 28 illustrates alternative provisions for retaining and guiding moving components, such as the moving members 124 and the moving rocking member 220 (for clarity, not shown in FIG. 28). As shown, in this embodiment, retaining elements 210, which each have cut-outs to receive a protrusion of a rocking member, are provided on both the top shell 200 and the bottom shell 202. When the top shell 200 and the bottom shell 202 are assembled together, the opposing retaining elements 210 may contact each other and form openings (e.g., circular openings) that retain protrusions of a rocking member and allow the protrusions to rotate within the openings. In addition, rather than providing ribs on the top shell 200, in this embodiment, a plurality of ribs 313 is provided on the bottom shell 202. Those ribs 313 may extend from an inner surface 311 of bottom shell 202 and may be configured similarly to the plurality of ribs 312 shown and described above in reference to FIGS. 7-8. In particular, ribs 313 may be arranged to coincide with the perimeters of the openings 300 and 302 of the top shell 200 when the top shell 200 and the bottom shell 202 are assembled together, and may be spaced apart to form slots 331 between adjacent ribs 313. In embodiments, ribs 313 may not need to be reinforced by a secondary rib (such as the secondary ribs 339 shown in FIG. 7), for example, if the relative sizes and thicknesses of the remaining portions of the bottom shell 202 provide adequate sturdiness. Since in this embodiment the bottom shell 202 defines the plurality of ribs 313, the top shell 200 may define just the openings 300 and 302, which align with the openings defined by the ribs 313.

Figure 14:
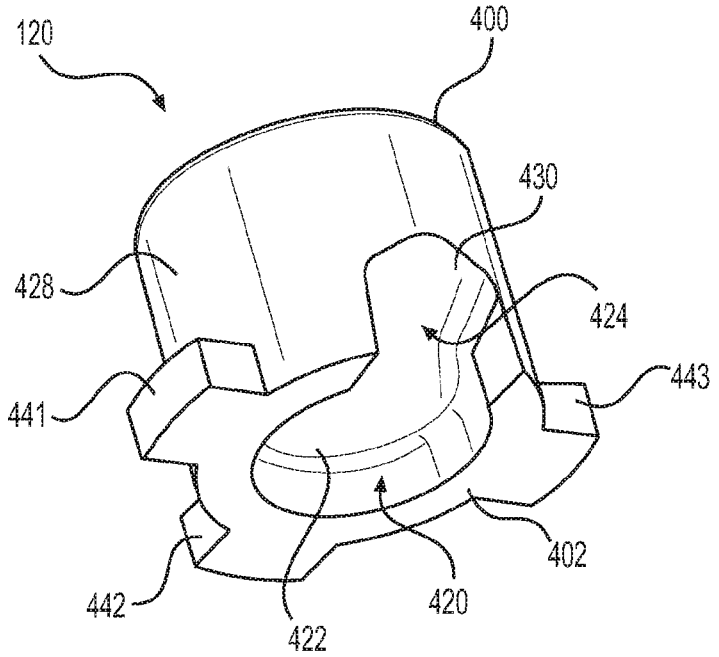
FIG. 14 is a schematic diagram that depicts an isometric perspective view of an embodiment of a lower end of a moving member including a cut-out for receiving an arm of a rocking member.
Figure 15:
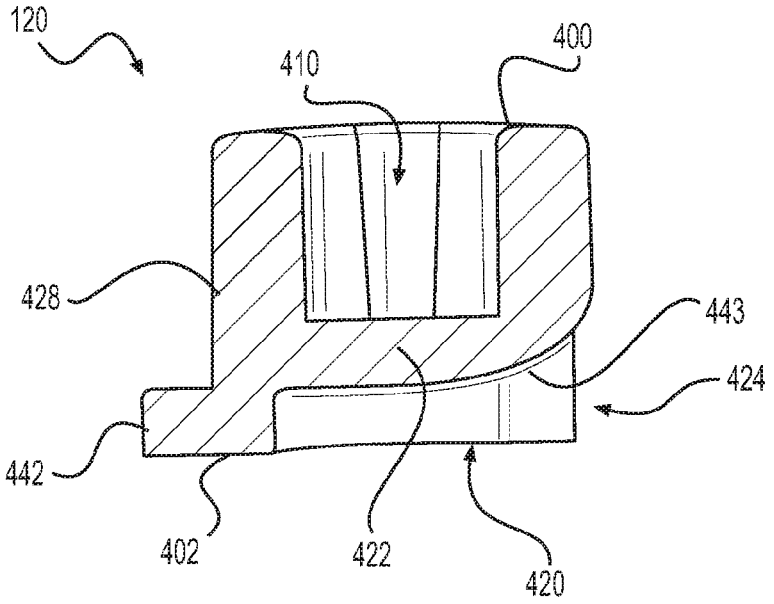
FIG. 15 is a schematic diagram that depicts a side cross-sectional view of the moving member of FIG. 12, along the plane 15-15 indicated in FIG. 12, according to an embodiment.

FIGS. 11-15 illustrate various views of first moving member 120, or simply moving member 120. Specifically, FIGS. 11-14 depict isometric views, while FIG. 15 depicts a cross-sectional view as taken along a plane 15-15 indicated in FIG. 12. Although the discussion focuses on first moving member 120, it may be appreciated that in at least some embodiments second moving member 122 may be similar or substantially identical to first moving member 120. In some cases, using identical moving members may improve manufacturing by reducing the number of parts and tools, and by reducing the possibility of using the wrong moving member within a particular opening of a block.

Moving member 120 may have a first end 400 and a second end 402. First end 400, clearly visible in FIGS. 11-13, may include a central recessed portion 410 that is approximately cylindrical in shape. This configuration provides an annular outer surface 412 disposed at first end 400. Second end 402, which is best seen in FIG. 14, may also include a central recessed portion 420 that is separated from central recessed portion 410 of first end 400 by a base portion 422 of moving member 120. In some embodiments, moving member 120 may also include a cut-out 424 that comprises an opening in the sidewall portion 428 of moving member 122 at second end 402. Cut-out 424 may open to central recessed portion 420. Moreover, in some embodiments, the outer surface portion 430 extending from central recessed portion 420 to sidewall portion 428 may be rounded or smoothly curved. This feature may facilitate a smooth interface between moving member 120 and rocking member 220 as discussed in further detail below.

A moving member may include provisions for interfacing with one or more ribs of a top shell. In some embodiments, a moving member could include one or more tab members that engage the spaces, or slots, between adjacent rib members extending from an inner surface of a top shell. As seen in FIGS. 11-14, in embodiments, moving member 120 may include three tabs, including a first tab 441, a second tab 442, and a third tab 443. Each tab may project outwardly from sidewall portion 428 of moving member 120. Moreover, each tab may be shaped and sized to fit within the slots between adjacent ribs in top shell 200, as can be best seen in FIG. 17. For example, in FIG. 17, second tab 442 is seen to be inserted within slot 451 between first rib 321 and fourth rib 324. These tabs may help prevent first moving member 120 from escaping out of the block through an opening. In addition, the tabs and ribs may assist in providing an aligned, smooth movement of a moving member through an opening of a top shell.

Figure 16:
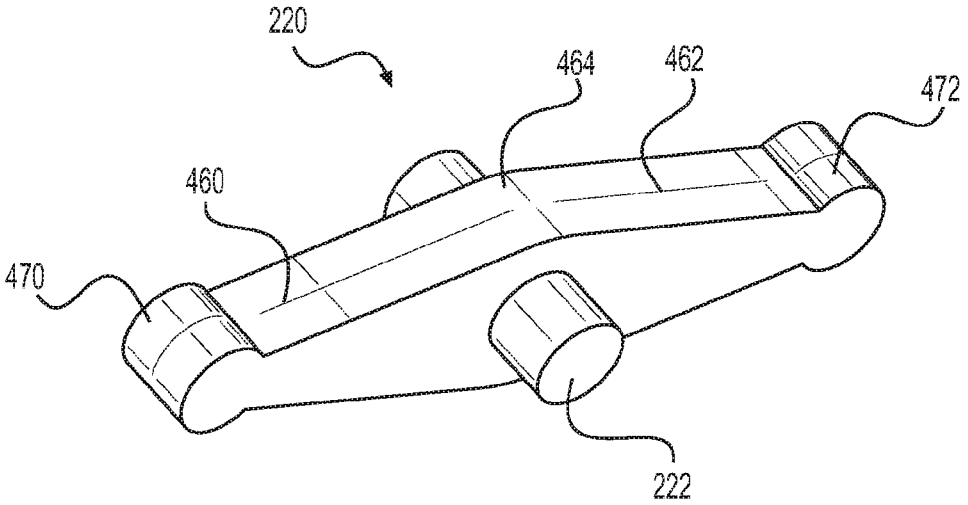
FIG. 16 is a schematic diagram of an isometric perspective view of an embodiment of a rocking member.
Figure 17:
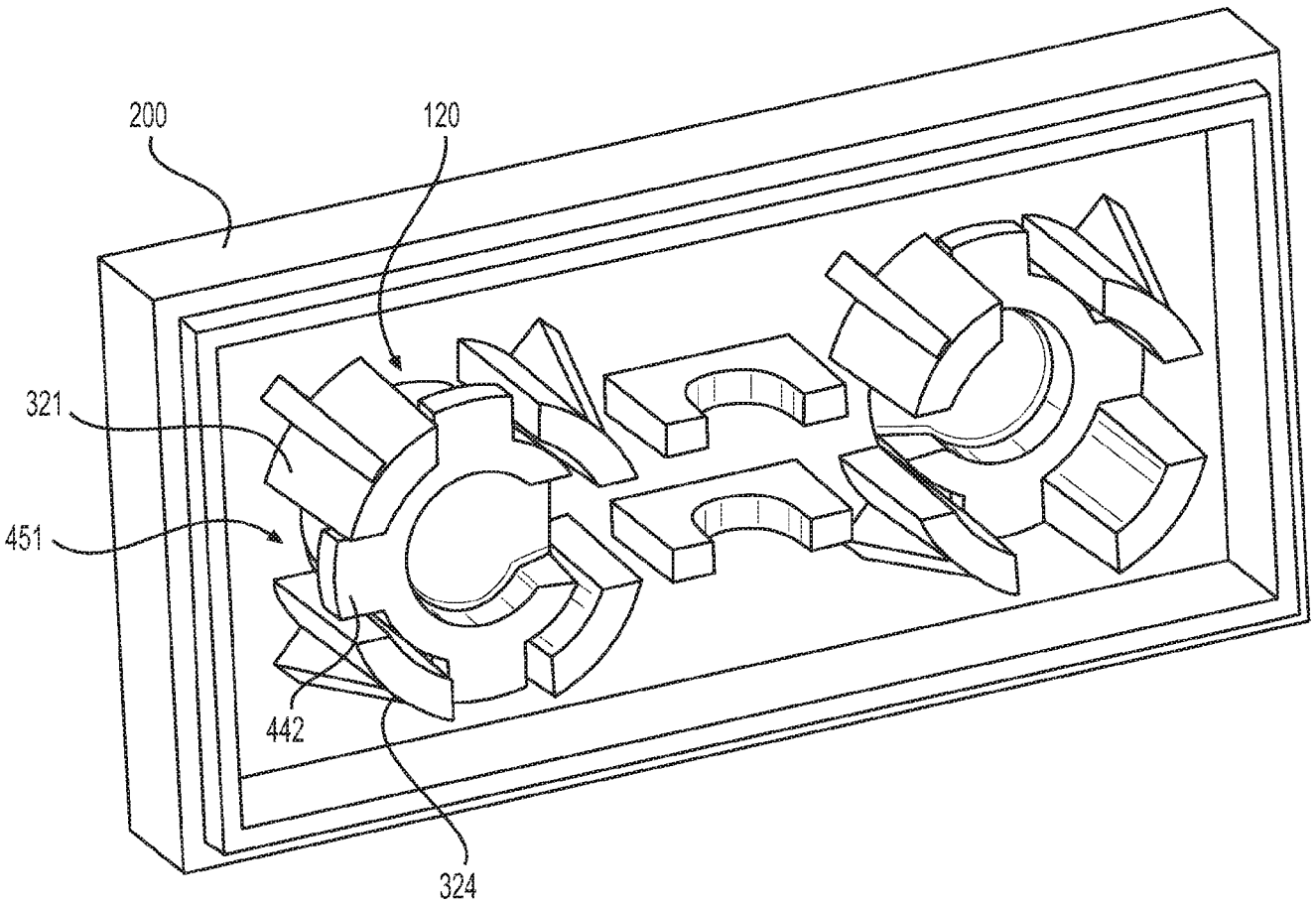
FIG. 17 is a schematic diagram of an isometric perspective view of an embodiment of a pair of moving members engaged with ribs of a top shell of a block.

FIG. 16 illustrates a schematic isometric view of rocking member 220, according to an embodiment. Rocking member 220 may comprise a first arm 460 and a second arm 462 that extend in a symmetric manner from a center portion 464. Each arm may have a width that tapers toward a rounded end. First arm 460 may include a first end 470 and second arm 462 may include a second end 472. In some cases, first end 470 and second end 472 may be rounded, having circular cross-sectional shapes when taken longitudinally along rocking member 220. In other cases, rather than the protruding partial circular shapes shown in FIG. 16, the ends of a rocking member could simply be rounded vertices of an appropriate radius of curvature. The tapered width and rounded ends of rocking member 220 may help to provide continuous sliding contact with the bottom of a moving member that may be mounted or placed atop an end of rocking member 220.

Rocking member 220 may provide a pivoting element or lever to transform the linear motion of the moving members into rotational motion of rocking member 220. Rocking member 220 therefore may provide a see-saw effect when moving members are positioned over its ends, where one moving member is pushed up as the other is pushed down. In other embodiments, a rocking member could be omitted and another type of actuating system could be used to move the moving members. Instead of rocking members, other actuating systems may transfer the up/down motions of one moving member to the other moving member using different means. For example, in an embodiment, a push-rod with rounded ends could be used. In such an embodiment, as a moving member is pressed down against one rounded end of the push-rod, the push-rod may be translated in a direction substantially parallel with the top portion, which drives the opposing rounded end of the push-rod into the other moving member thereby lifting that moving member up.

In other embodiments, instead of, or in addition to, transferring up/down motions of one moving member to another moving member, an actuating member may be separately driven to move the moving members. For example, in an embodiment, a cam mechanism could be used to move the moving members. The cam mechanism could include a single cam that is rotated and pushes one or more moving members on one or more faces of a construction element. Or, the cam mechanism could include multiple cams disposed on a camshaft at different longitudinal positions, each cam pushing one or more moving members. Examples of suitable cam mechanisms are described in reference to the reorientation mechanisms of U.S. Pat. No. 8,920,207 to Hageman et al., which is herein incorporated by reference in its entirety. Embodiments of these separately-driven actuating members, such as cam mechanisms, are described further below.

Figure 18:
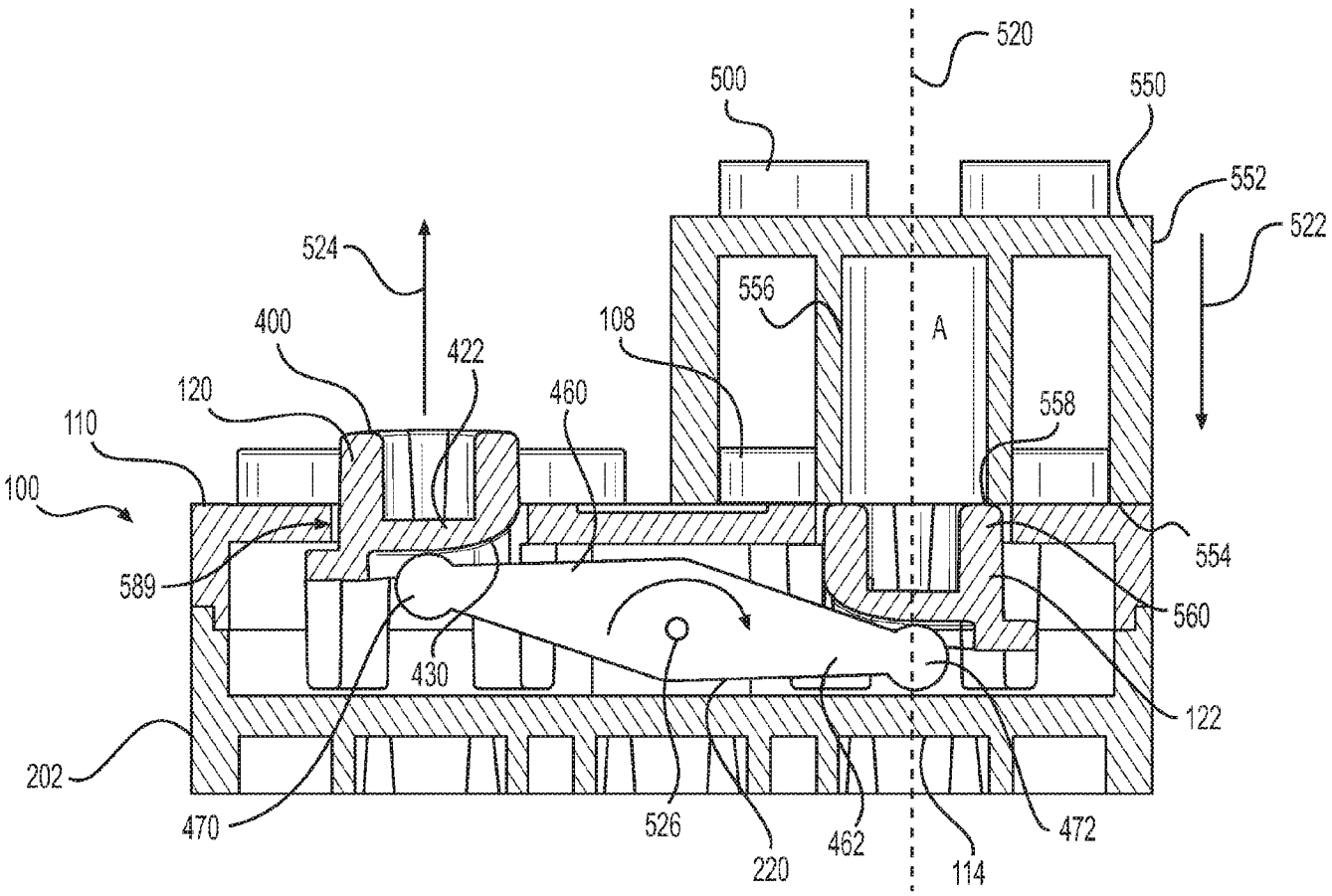
FIG. 18 is a schematic diagram depicting a side cross-sectional view of a first block being loaded onto the actuating block of FIG. 1 and engaging with a moving member, according to an embodiment.
Figure 19:
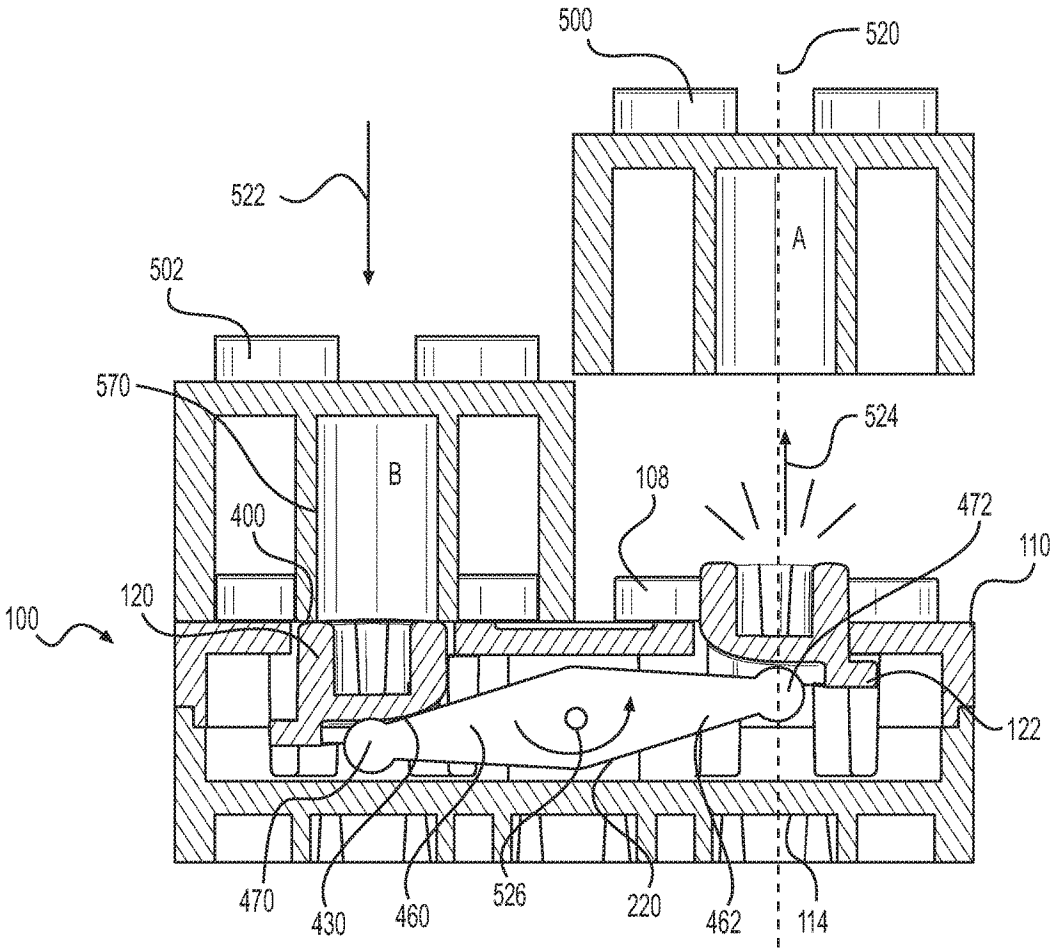
FIG. 19 is a schematic diagram depicting a side cross-sectional view of the first block of FIG. 18 being separated from the actuating block of FIG. 1 after a second block is loaded onto the actuating block of FIG. 1 and depresses an adjacent moving member, according to an embodiment.

FIGS. 18-19 illustrate side cross-sectional views of an embodiment of block 100 interacting with two different engagement blocks that may activate, or be actuated by, block 100. In the following description, various axes and directions are used to clarify the operation of block 100. Block 100 may be characterized by a first retracting direction 522 and an opposing second extending direction 524 that are oriented generally along a translation axis 520. Translation axis 520 may be defined as substantially perpendicular to the plane formed by the surface of top portion 110 of block 100. Thus, translation axis 520 extends from top portion 110 to the recessed lower portion 114 of block 100. Block 100 may also be characterized by a rotational axis 526 about which rocking member 220 pivots or rotates.

For purposes of distinguishing between the block with moving members and separately attached blocks or construction elements, the attached blocks or construction elements may be referred to as "engagement construction elements," "engagement elements," or "engagement blocks," where an engagement element is any block or other construction element (e.g., structures or figurines) configured to engage the pegs on a face of a block with moving members (and thereby interact with one or more moving members). An engagement element could be any kind of block or other construction element configured to receive pegs on a block and thereby form a stable connection between the block and the engagement element. The embodiment of FIGS. 18-19 depicts 2×2 engagement blocks; however, other engagement blocks could be configured as any other array sizes (1×1, 1×2, 2×3, etc.).

Referring to FIG. 18, an engagement element, first block 500 (also referred to as an "action block"), may be loaded onto one side of block 100. Specifically, since first block 500 has a 2×2 configuration, first block 500 may be loaded onto a 2×2 array subset of block 100, which is centered about second moving member 122. As first block 500 is fit onto the pegs 108 of block 100, first block 500 pushes second moving member 122 down in a retracting direction 522. As second moving member 122 is pushed down, second moving member 122 may translate through second opening 302 (see FIG. 6), which extends through top portion 110 and is further defined by plurality of ribs 312. Specifically, second moving member 122 may translate in generally the first retracting direction 522 along translation axis 520, or towards bottom shell 202, and may push second arm 462 of rocking member 220. This linear translation of second moving member 122 may act to rotate rocking member 220 about rotational axis 526 (clockwise in FIG. 18). Therefore, as second arm 462 of rocking member 220 is moved towards bottom shell 202, first arm 460 of rocking member 220 may be moved away from bottom shell 202, which acts to raise or lift first moving member 120 in generally the second extending direction 524. Therefore, once first block 500 has been installed into block 100, second moving member 122 is placed in a retracted position within the interior of block 100 and first moving member 120 is placed in a protruding or extended position so that first end 400 of first moving member 120 extends outwardly of top portion 110.

More generally, to load any block onto a block, an engagement block, or action block, can be inserted onto any of one, two, three, or four pegs surrounding a moving member. By fitting the engagement block onto at least one peg adjacent the moving member, a portion of the engagement block may push down on the moving member so that the other moving member is pushed up due to the rocking member.

FIG. 19 illustrates the resulting action when another engagement block is used to press down on first moving member 120, which is initially configured in a raised position (as in FIG. 18). As a second block 502 is fitted onto the open 2×2 array of pegs 108 on block 100, second block 502 may press down on first moving member 120 in generally the first retracting direction 522, which in turn pushes first arm 460 of rocking member 220. This action lifts second moving member 122 as rocking member 220 is rotated in a direction of rotation (counter-clockwise in FIG. 19) opposite to the direction of rotation that occurred as first block 500 was loaded onto block 100, and pushes second moving member 122 in generally the second extending direction 524. Thus, as first moving member 120 is pressed down by second block 502, second moving member 122 drives first block 500 off of the pegs of block 100. The motion ends with a "pop" effect created by the release of the pressure from the inner walls of first block 500 on pegs 108. A detailed discussion of the relevant forces is provided below with respect to FIGS. 20-21.

The engagement between each moving member and an engagement block can be achieved in various ways. In the embodiment of FIGS. 18-19, each moving member may be configured to directly engage a central inner wall (e.g., a cylindrical wall) that extends from a top portion of the engagement block to an open bottom portion of the block. For example, first block 500 may have a top portion 550, sidewalls 552, and an open bottom portion 554. First block 500 may also include a central cylindrical wall 556 that extends downwardly from top portion 550. Second moving member 122 may be sized and shaped to contact wall 556 (i.e., an end portion 560 of second moving member 122 engages an end portion 558 of wall 556). Likewise, second block 502 is seen to include a central cylindrical wall 570 that is directly engaged by first end portion 400 of first moving member 120.

While the exemplary embodiments depict moving members contacting cylindrical walls of an engagement block, it may be appreciated that in other embodiments or operating configurations a moving member could contact and apply a force against an outer sidewall of a block, or any other region of a block that is generally disposed at an end portion of the block that receives the pegs of a block. Thus, it should be appreciated that in other embodiments, the geometry and/or size of a moving member could be modified and still facilitate the actuation of an engagement block.

Figures 24, 25, 26, 27:
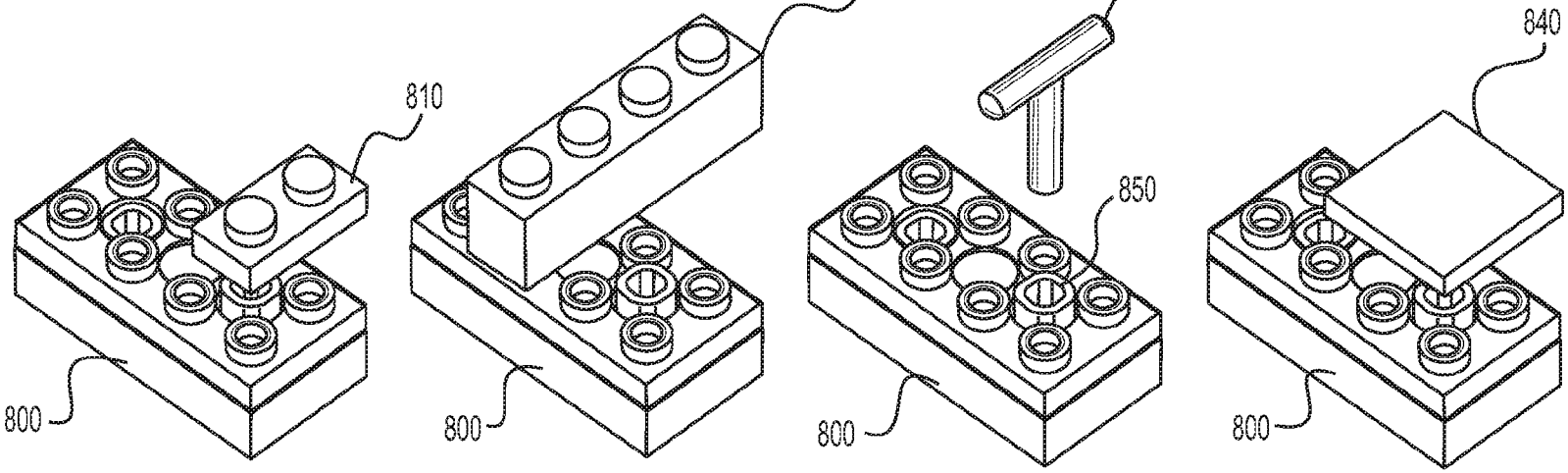
FIGS. 24-27 are schematic diagrams that depict isometric views of a block with moving members that may be triggered by different kinds of construction elements, according to embodiments.

It may be further appreciated that in at least some operating configurations, a raised or protruding moving member may be pressed or otherwise moved by a user's hand or figure or by another toy component, rather than being pressed directly by another block. For example, a suitably-shaped rod or handle may be inserted into a central recessed portion 410 of a moving member 120, and then pushed and pulled to move the moving member 120. An example of a rod engaging a moving member is depicted in FIG. 26 and discussed below. Moreover, in some embodiments, central recessed portion 410 may be sized and shaped to specifically accommodate particular components used in various construction systems.

In some cases, a block may include provisions to reduce possible friction between a moving member and the shell holding the moving member. As seen in FIG. 18, for example, block 100 may define a small gap 589 between the sidewall of first moving member 120 and the edge of first opening 300 (see FIG. 7) through which first moving member 120 extends. Likewise, a similar gap may be defined between second moving member 122 and second opening 302 (see FIG. 7). This arrangement may allow moving members 300 to move freely with no or minimal friction.

In some embodiments, the height of each moving member could be selected to achieve a desired detachment of an engagement element. For example, in the embodiments shown in FIGS. 18-19, both first moving member 120 and second moving member 122 are seen to have a height that is greater than a height of the pegs 108. Specifically, in FIG. 18 first moving member 120 is seen to extend above adjacent pegs 108 in the extended position and to be disposed below the base of the pegs 108 in the retracted position. The height may be selected so that a moving member does not interfere with an engagement block when the moving member is fully retracted (or pushed down by the engagement block) and so that the moving member travels higher than the tops of the pegs in the extended position to push the engagement block all of the way off of the pegs.

As previously discussed, a moving member and a rocking member could be configured to facilitate a smooth and continuous connection between these components, and to facilitate smooth movement of these components. As seen in FIGS. 18-19, the rounded surface of first end 470 of rocking member 220 allows for constant contact between first end 470 and base portion 422 (which rests on rocking member 220) of first moving member 120. In particular, for each possible rocking angle of rocking member 220 the rounded shape of first end 470 may ensure substantially continual contact with moving member 120. This constant contact may keep the forces between these components directed vertically (i.e., the forces are directed parallel to the translation axis) to increase efficiency of the actuation. This may be contrasted with an alternative embodiment where the contact surfaces between rocking member 220 and moving member 120 are substantially flat. In such an alternative embodiment—which may still be functional—the flat contacting surfaces might prevent consistent contact between base portion 422 and first end 470 at various rocking angles of rocking member 220.

Additionally, as seen in FIG. 19, the curved (or sloped) outer surface portion 430 of first moving member 120 allows first moving member 120 to travel freely without interfering with rocking member 220.

Figure 20:
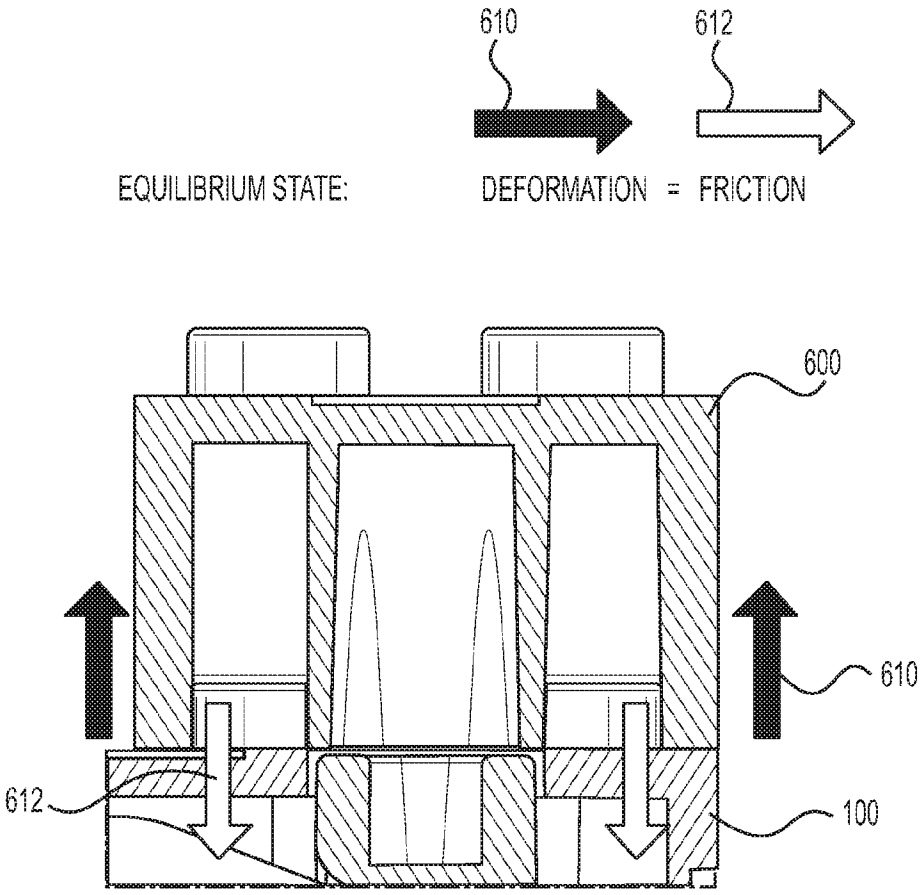
FIGS. 20-21 are schematic diagrams depicting the various forces that occur prior to and after a moving member has been activated to detach a block from the actuating block of FIG. 1, according to an embodiment.
Figure 21:
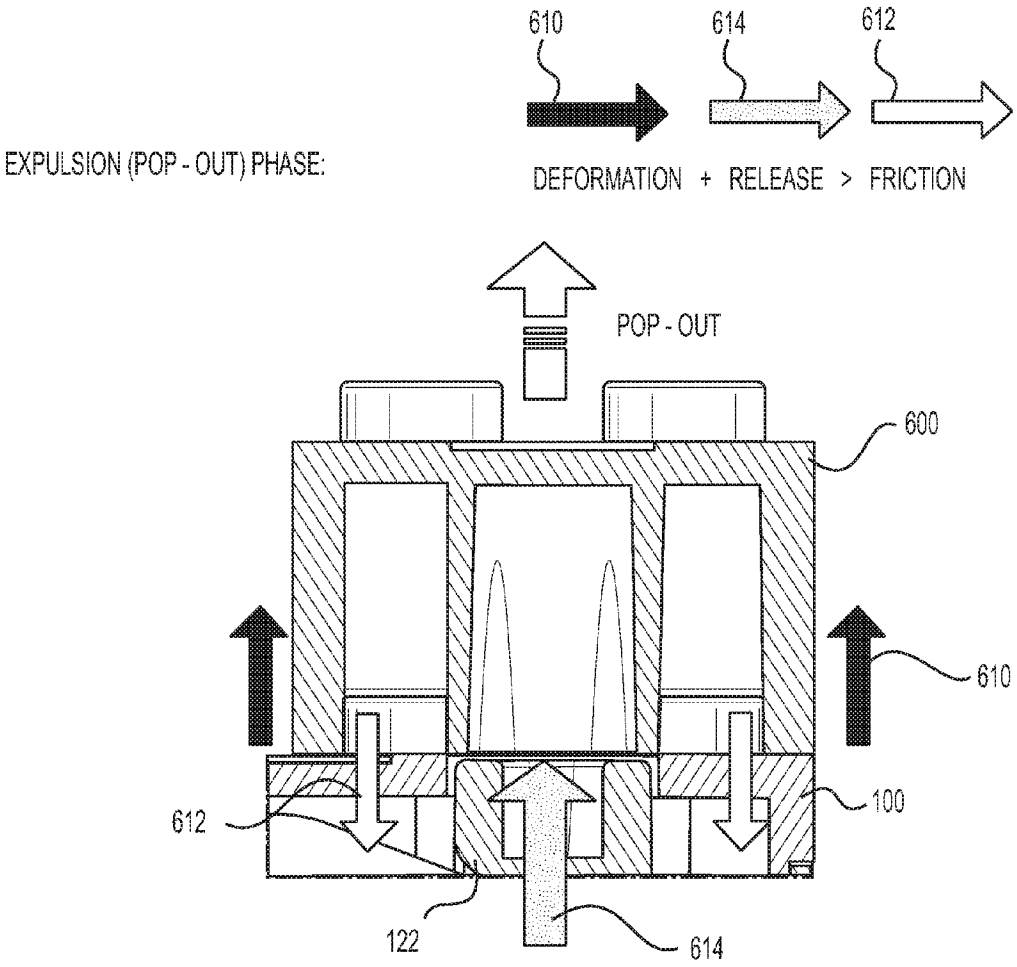

FIGS. 20-21 illustrate side cross-sectional views of a portion of block 100 and a corresponding engagement block 600 for purposes of describing the forces that may be involved during the attachment and detachment of blocks using the exemplary systems, according to embodiments. Generally, when two blocks are assembled together, the interference fit between the walls of the top block (i.e., engagement block 600) and the prongs of the bottom one (i.e., block 100) may cause an elastic deformation in the different components. This deformation may create a deformation force 610, which tends to expel the top block (i.e., engagement block 600). The frictional force 612 between the walls and the pegs may allow the combined block system (i.e., engagement block 600 and block 100 together) to be stable and to stay together. A force from underneath the top block, i.e., the release force 614, can disrupt this equilibrium by overpowering the friction that keeps the parts together. The release force 614 combines with the deformation force 610, and when those two forces become greater than the frictional force 612, the top block may be popped out of the assembly. In exemplary embodiments, the release force 614 may be provided when a moving member (e.g., moving member 122) is raised and pushes against the top block (i.e., engagement block 600).

It may be appreciated that the energy released when the action block or engagement block is separated from the block, can be large enough to propel the released block inches or even feet. The energy released may be created by a very tight fit of the pegs of the block to the bottom of the action or engagement block. Thus, the release force applied by the moving member may allow for a release of energy that is stored in the interference fit between blocks and which otherwise would be unused. In embodiments, the configuration of a moving member centrally disposed between four pegs arranged in a square configuration (e.g., as shown in FIG. 1) has led to surprising benefits in providing a favorable, tight fit and a relatively large release of energy for impressive propulsions of engagement blocks, especially for engagement blocks that engage all four pegs. However, engagement blocks need not engage all four pegs to achieve desirable propulsion results.

Figure 22:
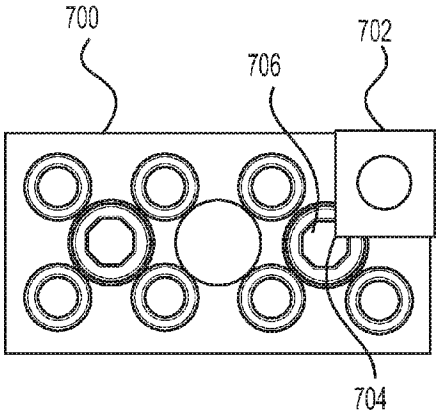
FIG. 22 is a schematic diagram that depicts a plan view of an embodiment with the block of FIG. 1 attached to a 1×1 block array.
Figure 23:
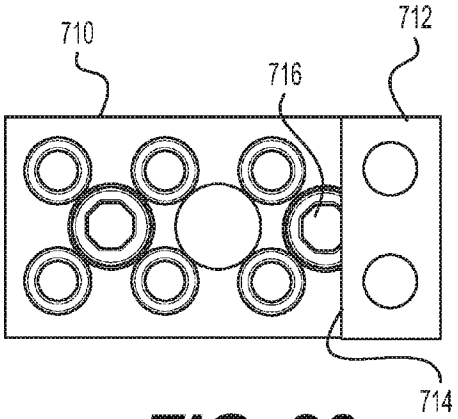
FIG. 23 is a schematic diagram that depicts a plan view of an embodiment with the block of FIG. 1 attached to a 1×2 block array.

FIGS. 22-23 illustrate other operating configurations according to embodiments. As seen in FIGS. 22-23, moving members of a block need not engage a central portion (e.g., cylindrical wall) to contact and actuate (or be activated by) an engagement block. For example, in the embodiment shown in FIG. 22, a block 700 may receive a 1×1 array block 702. It may be seen that a corner 704 of block 702 overlies a portion of a moving member 706, thereby allowing moving member 706 to actuate (and be activated by) block 702 even though block 702 is not centered about moving member 706. It may also be appreciated that in other configurations a 1×1 rounded element (e.g., a 1×1 block with a disc-like shape) could also be used to trigger a block. In a similar manner, a 1×2 array block 712 is shown as fitted onto a block 710 in FIG. 23. It is clear that an edge or sidewall 714 of block 712 also overlies a portion of moving member 716 and thereby can still activate, or be actuated by, moving member 716.

FIGS. 24-27 depict various means for triggering a block 800, according to embodiments. In FIG. 24, as previously discussed, a 1×2×⅓ (here ⅓ is an indicator of the part height relative to a normalized unit) engagement block 810 could trigger block 800 (e.g., press down on a moving member). In FIG. 25, a 1×4×1 block 820 could trigger block 800. In FIG. 26, a T-bar construction element 830 could trigger block 800, by inserting a post of element 830 directly into an opening or recessed portion 850 of a moving member. Finally, FIG. 27 illustrates a configuration where a 2×2×⅓ no-post construction element 840 (here "no-post" refers to the lack of pegs) triggers block 800.

Various play patterns or activities may make use of a block with moving members (i.e., a block assembly) as described and shown in the embodiments of FIGS. 1-23. In one play pattern, for example, an action block could be used as a projectile in a game (e.g., a "puck" for projecting towards a goal in a toy construction that uses blocks to make elements of a hockey game.) Other possible uses include facilitating the quick demolition of a system of assembled blocks by quickly disconnecting an action block that provides structural stability for the system blocks. Various other play patterns or activities could also be achieved using one or more block assemblies that include the features discussed herein.

Although some embodiments may include moving members that are centrally located with respect to a matrix or array of pegs (e.g., between four pegs), in other embodiments a moving member could be located at any position relative to a matrix or array of pegs. For example, in some alternative embodiments, a moving member could be positioned at an irregular location relative to the matrix of pegs, for example being disposed between two pegs in a common row, or being disposed partially in a row of pegs while extending to the space between adjacent rows of pegs. In other embodiments, a moving member could be disposed in the center of a peg or could be centered about the position where a peg would otherwise be located within an array.

Figure 29B:
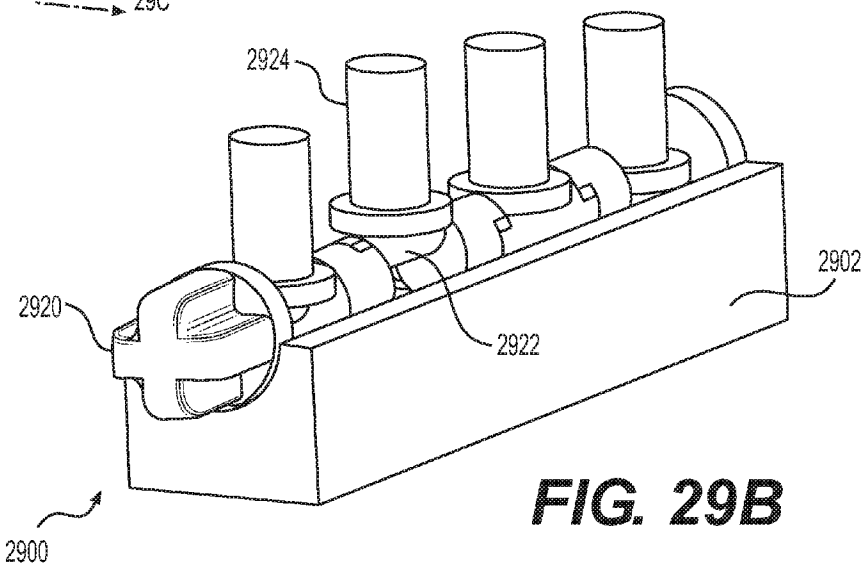
FIG. 29B is a schematic diagram of the actuating block of FIG. 29A with the top shell removed to show interior portions of the block, according to an embodiment.
Figure 29A:
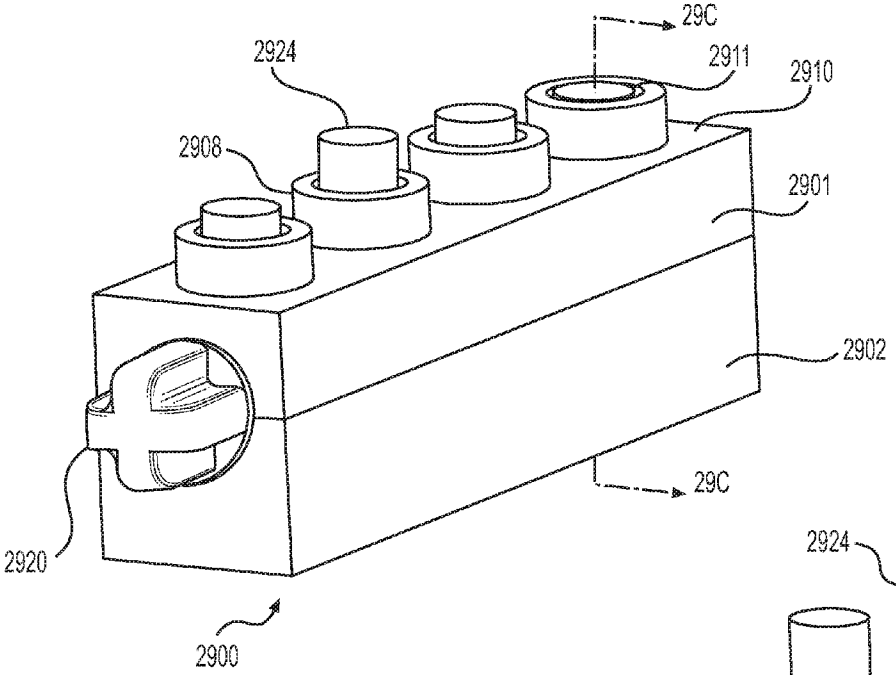
FIG. 29A is a schematic diagram that depicts a top isometric view of an embodiment of an actuating block having moving members disposed in the centers of pegs and having a cam-type, separately-driven, actuating member.

As an example, FIG. 29A illustrates an actuating block 2900 having a top portion 2910 from which a plurality of pegs 2908 protrude. In this case, block 2900 is a 1×4×1 block, although this embodiment could apply to any construction element on which a peg is disposed. Each peg 2908 may have a moving member 2924 centrally disposed in a recess defined by the peg 2908. For illustration purposes, FIG. 29B shows the block 2900 with the top shell 2901 removed to expose the components of the interior of the block 2900, including the interior portions of the moving members 2924 and the actuating member 2920, which rests on the bottom shell 2902 of the block 2900. The actuating member 2920 may be a camshaft with cams 2922, such that rotation of the actuating member 2920 causes the cams 2922 to rotate up and down and push the respective moving members 2924 up and down. The cams 2922 may be angularly offset from each other so that the moving members 2924 are raised at different times, for example, sequentially along the row of pegs 2908. As another example, cams 2922 could be positioned to raise the moving members 2924 in alternating patterns between pairs of pegs 2908. Each moving member 2924 may move along a translation axis defined by the peg 2908. For example, as shown in FIG. 29A, a peg 2908 and moving member 2924 may each be cylindrical and the moving member 2924 may be disposed in a cylindrical recess 2911 defined by the peg 2908, with the moving member 2924 moving along a translation axis coinciding with the longitudinal axes of the cylindrical peg 2908 and cylindrical moving member 2924.

Figure 29D:
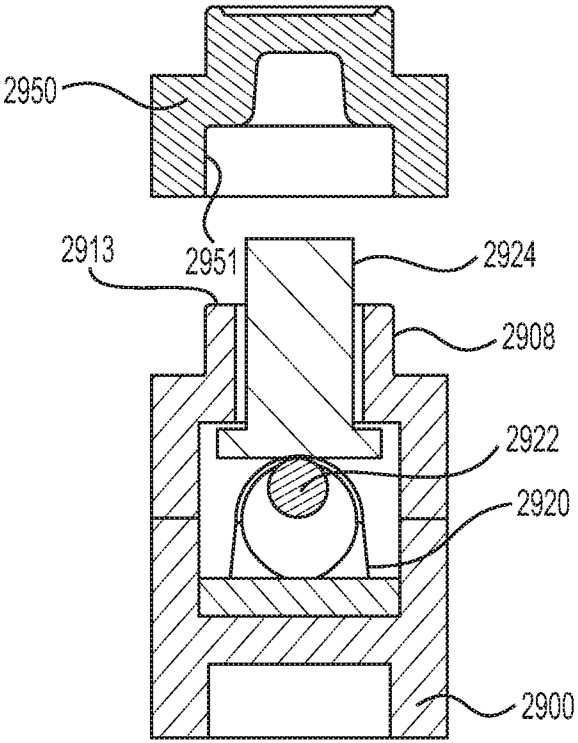
FIG. 29D is a schematic diagram of the cross-sectional view of the actuating block of FIG. 29C, after movement to a second condition at which the engagement block of FIG. 29C is disengaged from the actuating block, according to an embodiment.
Figure 29C:
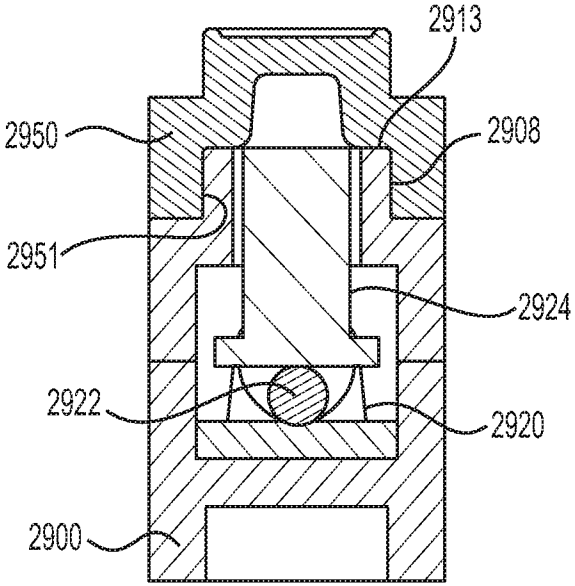
FIG. 29C is a schematic diagram of a cross-sectional view of the actuating block of FIG. 29A taken along plane 29C-29C of FIG. 29A, in a first condition with an engagement block engaged with the actuating block, according to an embodiment.

The cross-sectional views of FIGS. 29C-29D illustrate an embodiment of the actuating block 2900 in operation with an engagement block 2950. As shown in FIG. 29C, a recess 2951 defined by the engagement block 2950 may be engaged with outer surfaces of a peg 2908 in a first condition, with the cam 2922 of the actuating member 2920 at a lowest position and with the moving member 2924 retracted below or flush with an upper surface of the peg 2908. As actuating member 2920 is rotated, the cam 2922 may raise the moving member 2924, which then may extend beyond the upper surface 2913 of the peg 2908 and push the engagement block 2950 off of the actuating block 2900, as shown in the second condition of FIG. 29D, where the actuating member 2920 has been rotated 180 degrees relative to the position of FIG. 29C and the moving member 2924 is fully extended.

As described above, embodiments may use separately-driven actuating members to move the moving members of an actuating block. One embodiment of a separately-driven actuating member is the cam mechanism of the actuating block 2900 of FIGS. 29A-29D, which includes the actuating member 2920 extending out of the outer shell of the actuating block 2900. The portion of the actuating member 2920 extending out of the outer shell may be accessed and rotated to move the cams 2922 and the moving members 2924.

FIGS. 30A-30D illustrate another embodiment of a separately-driven actuating member, which may use a cam to move a moving member. As shown, in this embodiment, an actuating block 3000 may include a top shell 3001, a bottom shell 3002, an actuating member 3020, and a moving member 3024. The actuating member 3020 may be a camshaft that is rotatably held by, and in between, the top shell 3001 and the bottom shell 3002 and may have end portion 3021 substantially flush with outer surfaces of the shells 3001 and 3002. The end portion 3021 may define a recess 3023 into which a tool or other construction element may be inserted to rotate the actuating member 3020. Actuating member 3020 may also be rotated by hand. The actuating member 3020 may have a cam 3022 that lifts the moving member 3024 as the cam 3022 rotates.

Figure 30B:
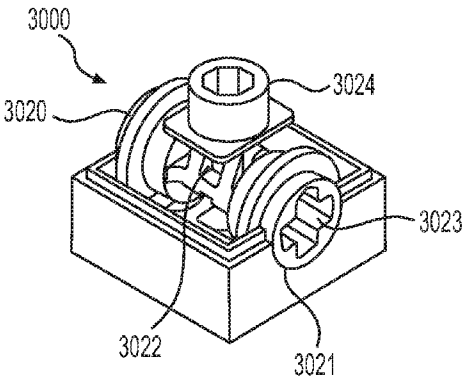
FIG. 30B is a schematic diagram of the actuating block of FIG. 30A with the top shell removed to show interior portions of the block, according to an embodiment.
Figure 30D:
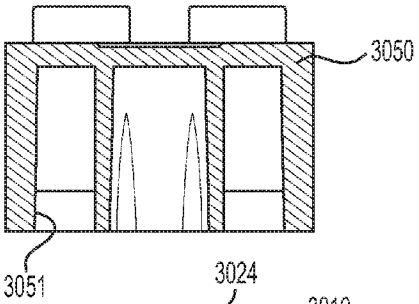
FIG. 30D is a schematic diagram of the cross-sectional view of the actuating block of FIG. 30C, after movement to a second condition at which the engagement block of FIG. 30C is disengaged from the actuating block, according to an embodiment.
Figure 30D:
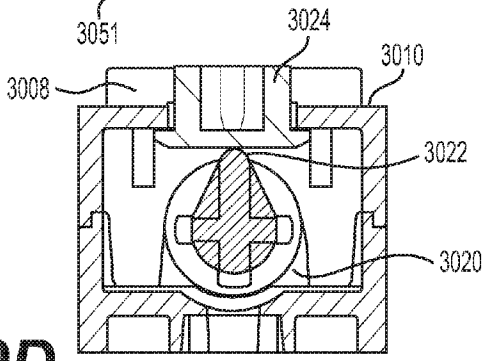
Figure 30A:
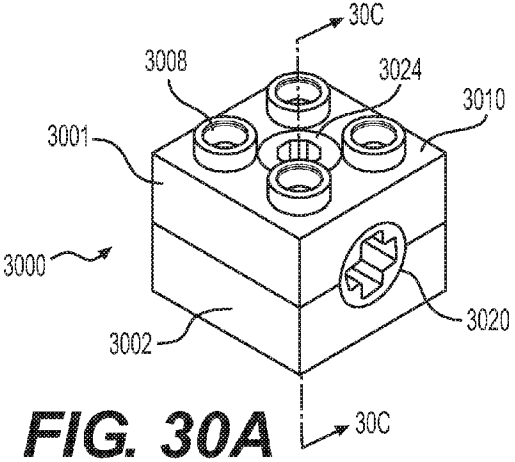
FIG. 30A is a schematic diagram that depicts a top isometric view of an embodiment of an actuating block having a moving member centrally disposed between four pegs arranged in a square configuration, and having a separately-driven actuating member that moves the moving member with a cam, according to an embodiment.
Figure 30C:
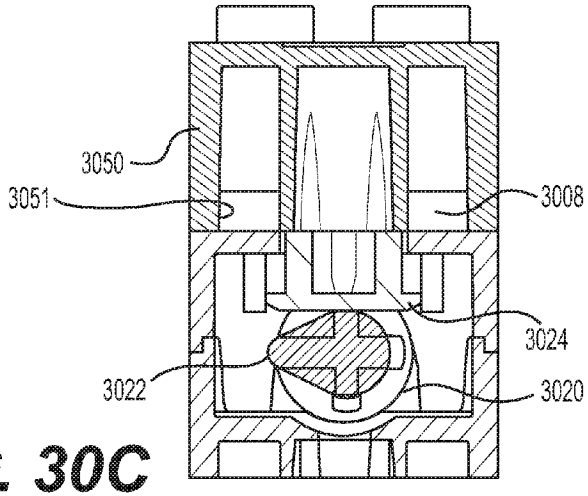
FIG. 30C is a schematic diagram of a cross-sectional view of the actuating block of FIG. 30A taken along plane 30C-30C of FIG. 30A, in a first condition with an engagement block engaged with the actuating block, according to an embodiment.

The cross-sectional views of FIGS. 30C-30D illustrate an embodiment of the actuating block 3000 in operation with an engagement block 3050. As shown in FIG. 30C, recesses 3051 defined by the engagement block 3050 may be engaged with outer surfaces of pegs 3008 in a first condition, with the extended portion of the cam 3022 (sometimes referred to as the nose) below and out of contact with the moving member 3024, and with the moving member 3024 retracted below or flush with the top surface 3010 of the actuating block 3000 from which the pegs 3008 protrude. As actuating member 3020 is rotated, in this example 90 degrees clockwise from the position in FIG. 30C, the cam 3022 may raise the moving member 3024, which then may extend beyond the top surface 3010 of the actuating block 3000 and push the engagement block 3050 off of the actuating block 3000, as shown in the second condition of FIG. 30D, where the extended portion of the cam 3022 is pointing upward and the moving member 3024 is fully extended.

Figure 31B:
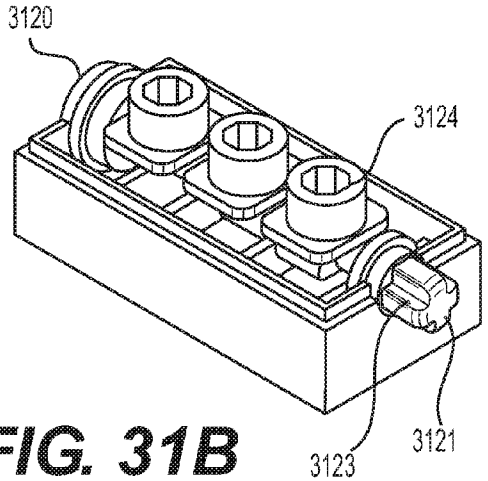
FIG. 31B is a schematic diagram of the actuating block of FIG. 31A with the top shell removed to show interior portions of the block, according to an embodiment.
Figure 31A:
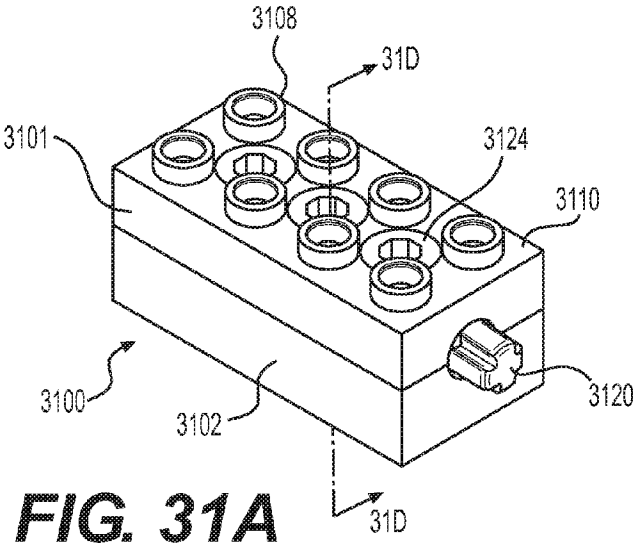
FIG. 31A is a schematic diagram that depicts a top isometric view of an embodiment of an actuating block having moving members, each centrally disposed between four pegs arranged in a square configuration, and having a separately-driven actuating member that moves the moving members using multiple cams, according to an embodiment.
Figure 31C:
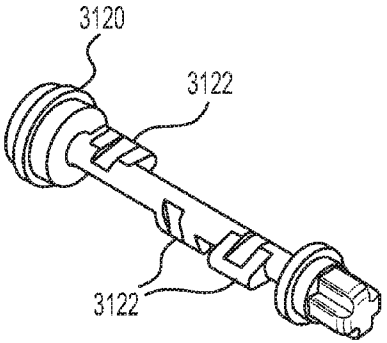
FIG. 31C is a schematic diagram of an isolated view of the actuating member of the actuating block of FIG. 31A, according to an embodiment.

FIGS. 31A-31E illustrate another embodiment of a separately-driven actuating member, which may use multiple cams to move multiple moving members, for multiple releases of engagement blocks. As shown, in this embodiment, an actuating block 3100 may include a top shell 3101, a bottom shell 3102, an actuating member 3120, and moving members 3124. The actuating member 3120 may be a camshaft that is rotatably held by, and in between, the top shell 3101 and the bottom shell 3102 and may have end portion 3121 that extends beyond outer surfaces of the shells 3101 and 3102. The end portion 3121 may define grooves 3123 with which a tool or other construction element may engage to rotate the actuating member 3120. Actuating member 3120 may also be rotated by hand. The actuating member 3120 may have one or more cams 3122 that each lifts one or more moving members 3124 as the cams 3122 rotate. In this example, each cam 3122 lifts one corresponding moving member 3124. As shown in FIG. 31C, which illustrates the actuating member 3120 in isolation, cams 3122 may be angularly offset from each other so that as the actuating member 3102 rotates, each cam 3122 pushes its respective moving member 3124 at a time different from that of the other cams and moving members. In other embodiments, the cams 3122 may angularly coincide with one or more other cams 3122 to push one or more moving members 3124 at the same time.

Figure 31E:
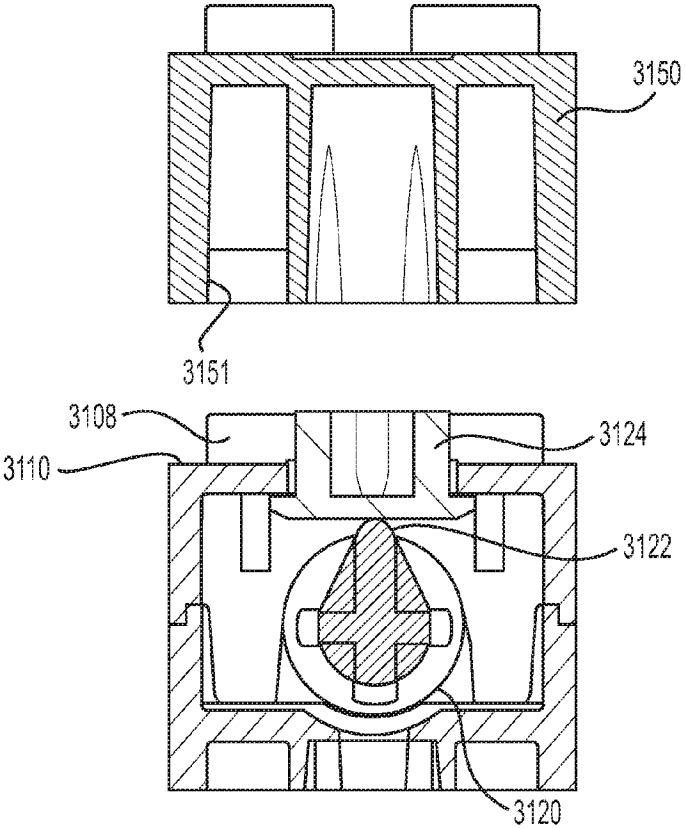
FIG. 31E is a schematic diagram of the cross-sectional view of the actuating block of FIG. 31D, after movement to a second condition at which the engagement block of FIG. 31D is disengaged from the actuating block, according to an embodiment.
Figure 31D:
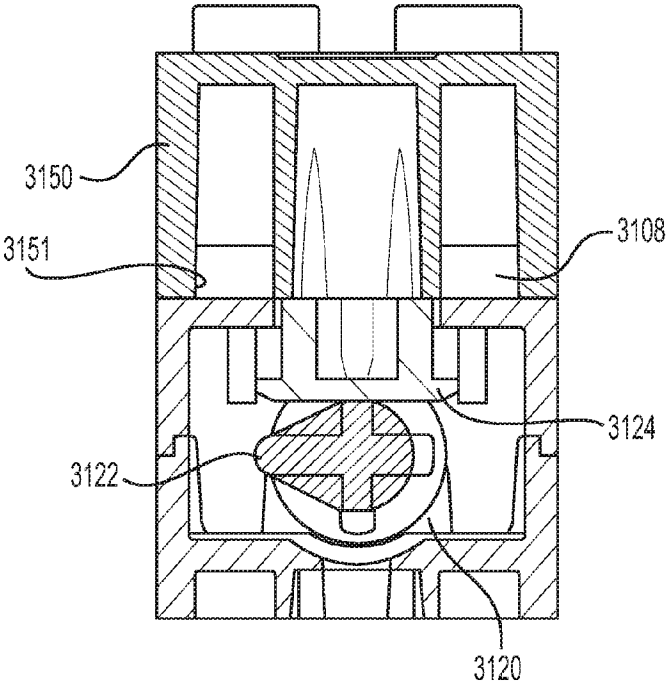
FIG. 31D is a schematic diagram of a cross-sectional view of the actuating block of FIG. 31A taken along plane 31D-31D of FIG. 31A, in a first condition with an engagement block engaged with the actuating block, according to an embodiment.

The cross-sectional views of FIGS. 31D-31E illustrate an embodiment of the actuating block 3100 in operation with an engagement block 3150. As shown in FIG. 31D (which is a lateral cross-section of the actuation block 3150 taken at the center moving member 3124 at plane 31D-31D in FIG. 31A), recesses 3151 defined by the engagement block 3150 may be engaged with outer surfaces of pegs 3108 in a first condition, with the extended portion of the center cam 3122 (sometimes referred to as the nose) below and out of contact with the center moving member 3124, and with the center moving member 3124 retracted below or flush with a top surface 3110 of the actuating block 3100 from which the pegs 3108 protrude. As actuating member 3120 is rotated, in this example 90 degrees clockwise from the position in FIG. 31D, the center cam 3122 may raise its respective center moving member 3124, which then may extend beyond the top surface 3110 of the actuating block 3100 and push the engagement block 3150 off of the actuating block 3100, as shown in the second condition of FIG. 31E, where the extended portion of the center cam 3122 is pointing upward and the center moving member 3124 is fully extended. At this second condition, the extended portions of the outer cams 3124 are below and out of contact with the outer moving members 3124, as evident from the angular positions of the cams 3122 in FIG. 31C.

Figure 32B:
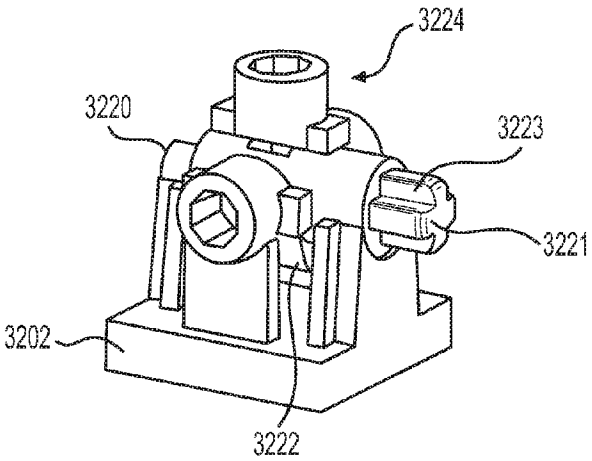
FIG. 32B is a schematic diagram of the actuating block of FIG. 32A with the top shell removed to show interior portions of the block, according to an embodiment.
Figure 32A:
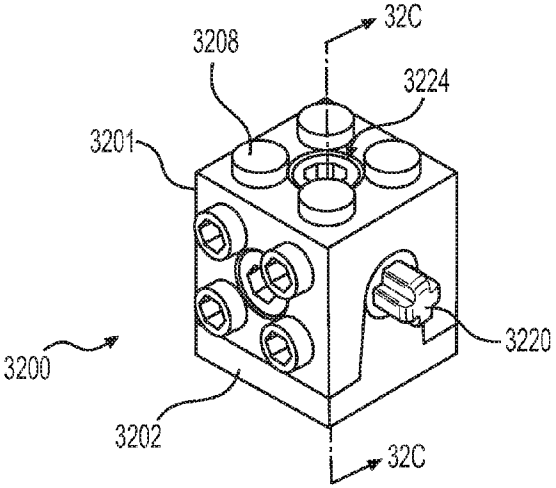
FIG. 32A is a schematic diagram that depicts a top isometric view of an embodiment of an actuating block having a separately-driven actuating member that uses a cam to move multiple moving members in different angular directions relative to the rotational axis of the cam, for multiple releases of engagement blocks off of differently facing outer surfaces of the actuating block, according to an embodiment.

FIGS. 32A-32F illustrate another embodiment of a separately-driven actuating member, which may use a cam to move multiple moving members in different angular directions relative to the rotational axis of the cam, for multiple releases of engagement blocks off of differently facing outer surfaces of an actuating block. As shown, in this embodiment, an actuating block 3200 may include a top shell 3201, a bottom shell 3202, an actuating member 3220, and moving members 3224. Each moving member 3224 may be disposed at a different face of the outer shell of the actuating block 3200. For example, as shown in FIGS. 32A and 32C-32F, a moving member 3124 may be disposed on each of a top surface and on two opposing side surfaces of the actuating block 3200, and may be radially aligned with each other relative to the rotational axis of the actuating member 3220. The actuating member 3220 may be a camshaft that is rotatably held by, and in between, the top shell 3201 and the bottom shell 3202 and may have an end portion 3221 that extends beyond outer surfaces of the shells 3201 and 3202. The end portion 3221 may define grooves 3223 with which a tool or other construction element may engage to rotate the actuating member 3220. Actuating member 3220 may also be rotated by hand. The actuating member 3220 may have one or more cams 3222 (in the example, of FIGS. 32A-32F, a single cam) that push the multiple moving members 3224 as the cam 3222 rotates. FIG. 32B illustrates the actuating block 3200 with the top shell 3201 removed for clarity, showing moving members 3124 in their retracted positions, with the cam 3122 not pushing any of the moving members 3124. The position of the cam 3122 in FIG. 32B corresponds to the position of the cam 3122 shown in the cross-sectional view of FIG. 32C.

Figure 32C:
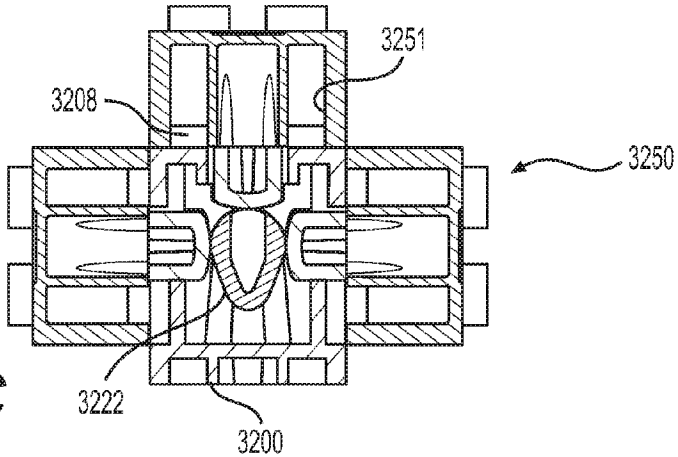
FIG. 32C is a schematic diagram of a cross-sectional view of the actuating block of FIG. 32A taken along plane 32C-32C of FIG. 32A, in a first condition with three engagement blocks each engaged with a differently facing outer surface of the actuating block, and with three corresponding moving members in retracted positions, according to an embodiment.
Figure 32E:
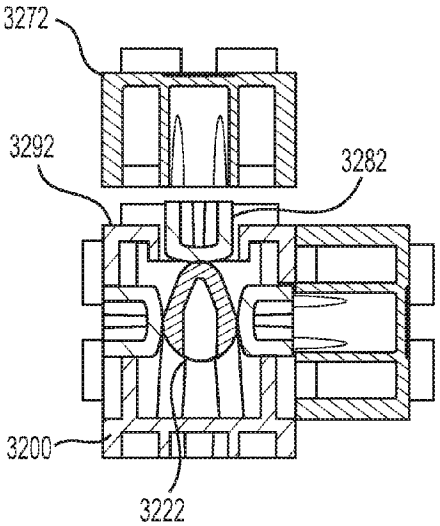
FIG. 32E is a schematic diagram of the cross-sectional view of the actuating block of FIG. 32C, after movement to a third condition at which the second engagement block of FIG. 32C is disengaging from the actuating block, with the third engagement block of FIG. 32C still engaged with the actuating block, according to an embodiment.
Figure 32D:
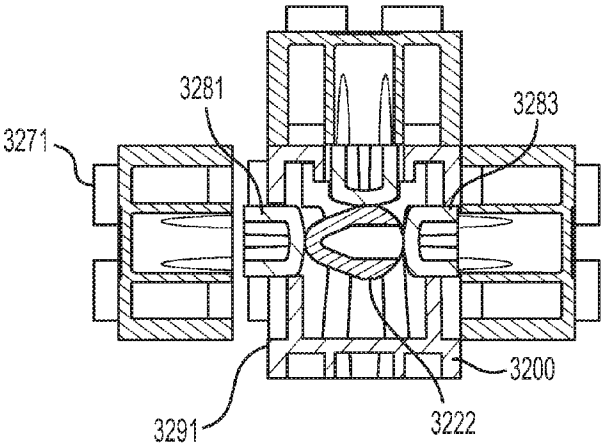
FIG. 32D is a schematic diagram of the cross-sectional view of the actuating block of FIG. 32C, after movement to a second condition at which the first engagement block of FIG. 32C is disengaging from the actuating block, with the second and third engagement block of FIG. 32C still engaged with the actuating block, according to an embodiment.
Figure 32F:
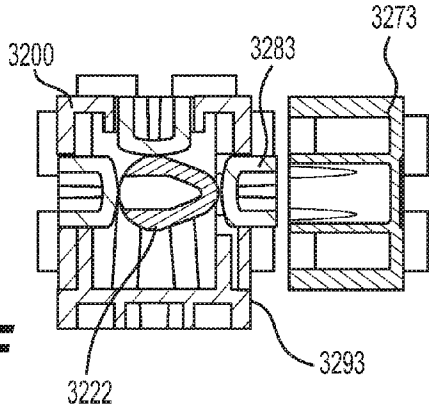
FIG. 32F is a schematic diagram of a cross-sectional view of the actuating block of FIG. 32C, after movement to a fourth condition at which the third engagement block of FIG. 32C is disengaging from the actuating block, according to an embodiment.

The cross-sectional views of FIGS. 32C-31F illustrate an embodiment of the actuating block 3200 in operation with multiple engagement blocks 3250. As shown in FIG. 32C (which is a lateral cross-section of the actuating block 3200 taken at the plane 32C-32C in FIG. 32A), recesses 3251 defined by the engagement blocks 3250 may be engaged with outer surfaces of pegs 3208 in a first condition, with the extended portion of the center cam 3222 (sometimes referred to as the nose) out of contact with the moving members 3224, and with moving members 3224 retracted below or flush with the respective outer surfaces of the actuating block 3200 from which the pegs 3208 protrude. As actuating member 3220 is rotated, in this example 90 degrees clockwise from the position in FIG. 32C, the cam 3222 may push first moving member 3281, which then may extend beyond the first side surface 3291 of the actuating block 3200 and push the first engagement block 3271 off of the actuating block 3200, as shown in the second condition of FIG. 32D, where the extended portion of the cam 3222 is pointing left and the first moving member 3281 is fully extended. From this second condition, as actuating member 3220 is further rotated clockwise 90 degrees, the cam 3222 may push second moving member 3282, which then may extend beyond the top surface 3292 of the actuating block 3200 and push the second engagement block 3272 off of the actuating block 3200, as shown in the third condition of FIG. 32E, where the extended portion of the cam 3222 is pointing upward and the second moving member 3282 is fully extended. From this third condition, as actuating member 3220 is further rotated clockwise 90 degrees, the cam 3222 may push third moving member 3283, which then may extend beyond the second side surface 3293 of the actuating block 3200 and push the third engagement block 3273 off of the actuating block 3200, as shown in the fourth condition of FIG. 32F, where the extended portion of the cam 3222 is pointing to the right and the third moving member 3283 is fully extended.

In alternative embodiments, rather than the single extended portion of the cam 3222 shown in FIGS. 32A-32F, a cam may have multiple extended portions so that the cam may push moving members at a higher frequency or may push multiple moving members simultaneously. For example, cam 3222 could have a second extended portion extending in a direction opposite to the extended portion shown in FIG. 32D, in which case the cam 3222 could push the first moving member 3281 and the third moving member 3283 simultaneously.

In alternative embodiments, rather than having a single cam pushing multiple moving members radially aligned relative to the rotational axis of an actuating member, an actuating block may have multiple cams longitudinally distributed along an actuating member, pushing moving members in different radial directions relative to the rotational axis, for example, at different faces of the actuating block. Referring to the actuating block 3100 of FIGS. 31A-31E, instead of having all of the moving members 3124 at the top surface of the actuating block, one or two of moving members 3124 could be disposed at a side surface or even bottom surface of the actuating block 3100.

In alternative embodiments a block could be configured as any sized block array and/or as a base plate of any array size. In such alternative configurations moving members could be located at the center of any square configuration of four pegs. Alternatively, it is contemplated that in some other embodiments a moving member could be used instead of a peg at a regular location in the array of pegs. In such embodiments the moving member could be sized and shaped to apply contact force against a portion of an engagement block that receives the adjacent pegs and overlies the location of the moving member. In still other embodiments it may be possible to connect three or more moving members using a rocking member with three or more arms. In such embodiments pressing on one moving member could actuate two, three, or more other moving members throughout the block or base plate assembly.

While moving members may be cylindrical or peg-like in some embodiments, in other embodiments moving members could have any other geometries and/or dimensions. For example, in other embodiments a moving member could be pin-like with widths or diameters much less than the widths or diameters of pegs projecting from the block. Moreover, the relative height of a moving member could vary in different embodiments and in some cases the height could be selected according to the height of the pegs (with respect to a face from which the pegs extend).

The foregoing disclosure of the preferred embodiments has been presented for purposes of illustration and description. It is not intended to be exhaustive or to limit the embodiments to the precise forms disclosed. Many variations and modifications of the embodiments described herein will be apparent to one of ordinary skill in the art in light of the above disclosure.

While various embodiments have been described, the description is intended to be exemplary, rather than limiting and it will be apparent to those of ordinary skill in the art that many more embodiments and implementations are possible that are within the scope of the embodiments. Any feature of any embodiment may be used in combination with or substituted for any other feature or element in any other embodiment unless specifically restricted. Accordingly, the embodiments are not to be restricted except in light of the attached claims and their equivalents. Also, various modifications and changes may be made within the scope of the attached claims.

Further, in describing representative embodiments, the specification may have presented a method and/or process as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process should not be limited to the performance of their steps in the order written, and one skilled in the art can readily appreciate that the sequences may be varied and still remain within the spirit and scope of the present embodiments.

What is claimed is:

1. A toy construction element, comprising:

an outer shell including an outer face;

four pegs projecting from the outer face and arranged in a rectangular configuration, wherein the outer shell defines an opening disposed between the four pegs at a center of the rectangular configuration;

a moving member disposed in the opening and configured to move in and out of the opening between a retracted position and an extended position, relative to the outer face of the outer shell; and an actuating member that moves the moving member from the retracted position to the extended position.

2. The toy construction element of claim 1, wherein the four pegs are disposed in a square configuration and the opening is disposed at a center of the square configuration.

3. The toy construction element of claim 1, wherein the outer shell retains the moving member within the opening in the extended position and prevents the moving member from fully exiting the opening.

4. The toy construction element of claim 1, wherein the moving member comprises a first end facing in a direction outward of the opening and a second end opposite to the first end, and wherein the actuating member pushes the second end of the moving member in the direction outward of the opening.

5. The toy construction element of claim 4, wherein the actuating member comprises a rocking member.

6. The toy construction element of claim 4, wherein the actuating member comprises a camshaft.

7. The toy construction element of claim 1, wherein the moving member comprises a first moving member, wherein the toy construction element further comprises a second moving member in contact with the actuating member, and wherein the second moving member moves the actuating member such that the actuating member moves the first moving member from the retracted position to the extended position.

8. The toy construction element of claim 1, wherein the moving member moves between the retracted position and the extended position along a translational axis that is substantially perpendicular to the outer face of the outer shell.

9. A toy construction element, comprising:

an outer shell including an outer face;

four pegs projecting from the outer face and arranged in a rectangular configuration, wherein the outer shell defines an opening disposed between the four pegs at a center of the rectangular configuration; and a moving member disposed in the opening and configured to move in and out of the opening between a retracted position and an extended position, relative to the outer face of the outer shell, wherein the outer shell has an inner face opposite to the outer face, wherein the toy construction element further comprises a first rib and a second rib that extend from the inner face and define a slot between the first rib and the second rib, and wherein the moving member defines a tab disposed and slideable within the slot.

10. A toy construction element, comprising:

an outer shell including an outer face;

a plurality of pegs projecting from the outer face and arranged in a matrix;

a first moving member positioned at a first location between the pegs of the matrix and moveable relative to the outer face from a first retracted position to a first extended position;

a second moving member positioned at a second location between the pegs of the matrix and moveable relative to the outer face from a second retracted position to a second extended position; and an actuating member, wherein movement of the second moving member from the second extended position to the second retracted position causes the actuating member to move the first moving member from the first retracted position to the first extended position.

11. The toy construction element of claim 10, wherein the first moving member is disposed at a center of a first rectangular configuration of four pegs, and wherein the second moving member is disposed at a center of a second rectangular configuration of four pegs.

12. The toy construction element of claim 11, wherein the first rectangular configuration and the second rectangular configuration are square configurations.

13. The toy construction element of claim 11, wherein the four pegs of the first rectangular configuration are different from the four pegs of the second rectangular configuration, and wherein, within the matrix, the four pegs of the first rectangular configuration are adjacent to the four pegs of the second rectangular configuration.

14. The toy construction element of claim 10, wherein the actuating member comprises a rocking member.

15. The toy construction element of claim 10, wherein the first moving member moves between the first retracted position and the first extended position along a first translational axis that is substantially perpendicular to the outer face of the outer shell, and wherein the second moving member moves between the second retracted position and the second extended position along a second translational axis that is substantially perpendicular to the outer face of the outer shell.

16. The toy construction element of claim 10, wherein movement of the first moving member from the first extended position to the first retracted position causes the actuating member to move the second moving member from the second retracted position to the second extended position.

17. The toy construction element of claim 10, wherein the outer shell defines a first opening disposed at the first location, wherein the outer shell has an inner face opposite to the outer face, wherein the toy construction element further comprises a first rib and a second rib that extend from the inner face at the first opening and define a first slot between the first rib and the second rib, and wherein the first moving member defines a tab disposed and slideable within the slot.

18. A toy construction system comprising:

an actuating element including:

an outer shell including an outer face, a plurality of pegs projecting from the outer face and arranged in a matrix, wherein the outer shell defines an opening; and a moving member disposed in the opening and configured to move in and out of the opening between a retracted position and an extended position, relative to the outer face of the outer shell; and an engagement element defining an opening that receives a peg of the plurality of pegs, wherein the moving member is aligned with an end portion of the engagement element when the engagement element is attached to the actuating element with the peg disposed in the opening, and wherein when the moving member moves from the retracted position to the extended position, the moving member pushes the end portion of the engagement element and detaches the engagement element from the actuating element.

19. The toy construction system of claim 18, wherein the plurality of pegs comprises four pegs in a rectangular configuration, and wherein the moving member is disposed at a center of the rectangular configuration.

20. The toy construction system of claim 18, wherein in the extended position, the moving member projects farther from the outer face of the outer shell than the peg of the plurality of pegs that is received in the opening of the engagement element.

* * * * *